US007336914B2

(12) United States Patent
Batori et al.

(10) Patent No.: US 7,336,914 B2
(45) Date of Patent: Feb. 26, 2008

(54) SEALING MEMBER FOR SEALING MAGNETIC PARTICLES AND DEVELOPING APPARATUS USING THE SEALING MEMBER

(75) Inventors: Yoshiyuki Batori, Mishima (JP); Teruhiko Sasaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 30 days.

(21) Appl. No.: 11/362,229

(22) Filed: Feb. 27, 2006

(65) Prior Publication Data

US 2006/0140666 A1 Jun. 29, 2006

Related U.S. Application Data

(62) Division of application No. 10/735,722, filed on Dec. 16, 2003, now Pat. No. 7,039,338.

(30) Foreign Application Priority Data

Dec. 20, 2002 (JP) ..... 2002-371020

(51) Int. Cl.
*G03G 15/08* (2006.01)

(52) U.S. Cl. ..... 399/104

(58) Field of Classification Search ..... 399/103, 399/104, 105, 106, 119, 267, 274
See application file for complete search history.

(56) References Cited

U.S. PATENT DOCUMENTS 5,697,021 A * 12/1997 Watanabe et al. ..... 399/102
5,790,923 A 8/1998 Oguma et al. ..... 399/106
5,812,909 A 9/1998 Oguma et al. ..... 399/103
6,021,291 A 2/2000 Karakama et al. ..... 399/104
6,029,030 A 2/2000 Yamaji et al. ..... 399/104
6,032,007 A 2/2000 Yamaji et al. ..... 399/104
6,044,237 A 3/2000 Numagami et al. ..... 399/104
6,151,467 A 11/2000 Yamaguchi ..... 399/104
6,160,976 A 12/2000 Karakama et al. ..... 399/104
6,185,393 B1 2/2001 Karakama et al. ..... 399/103

(Continued)

FOREIGN PATENT DOCUMENTS

CN 1217486 A 5/1999
JP 2002-196583 7/2002
JP 2002-258607 9/2002

*Primary Examiner*—Robert Beatty
(74) *Attorney, Agent, or Firm*—Fitzpatrick, Cella, Harper & Scinto

(57) ABSTRACT

A developing apparatus includes a developing container for containing a developer; a developer carrying member to be rotated while carrying the developer thereon, the developer carrying member being provided in an opening portion of the developer container; and a sealing member which extends in a circumferential direction of the developer carrying member in the vicinity of an end of the developer carrying member and regulates movement of the developer toward the end of the developer carrying member by a magnetic force, the sealing member including an arcuate portion extended along a peripheral surface of the developer carrying member and a non-arcuate portion disposed at an end, in the circumferential direction, of the arcuate portion. An end surface of the arcuate portion of the sealing member on a side where the non-arcuate portion is not provided, is inclined such that a phantom plane including the end surface is closer to the arcuate portion than a center of arcuation of the arcuate portion.

6 Claims, 20 Drawing Sheets

U.S. PATENT DOCUMENTS

| | | | | |
|---|---|---|---|---|
| 6,205,304 | B1 | 3/2001 | Kawaguchi | 399/103 |
| 6,266,500 | B1 | 7/2001 | Numagami et al. | 399/104 |
| 6,336,015 | B1 | 1/2002 | Numagami | 399/104 |
| 6,671,473 | B2 | 12/2003 | Miyabe | 399/104 |
| 6,708,010 | B2 | 3/2004 | Miyabe et al. | 399/104 |
| 6,915,091 | B2 | 7/2005 | Matsumaru et al. | 399/104 |
| 7,039,338 | B2 * | 5/2006 | Batori et al. | 399/104 |
| 2003/0012580 | A1 | 1/2003 | Miyabe | 399/103 |

* cited by examiner (a)

(b)

(a)

(b)

(a)

(b)

(a)

(b)

(a)

(b)

(a)

(b)

(a)

(b)

SEALING MEMBER FOR SEALING MAGNETIC PARTICLES AND DEVELOPING APPARATUS USING THE SEALING MEMBER

The application is a divisional of U.S. patent application Ser. No. 10/735,722, filed Dec. 16, 2003, which issued on May 2, 2006, as U.S. Pat. No. 7,039,338 B2.

FIELD OF THE INVENTION AND RELATED ART

The present invention relates to a magnetic sealing member for preventing leakage of magnetic particles, for use in a developing apparatus, a process cartridge or an electrophotographic image forming apparatus, and a developing apparatus using the sealing member.

Here, an electrophotographic image forming apparatus means an apparatus which forms an image on a recording medium with the use of an electrophotographic image forming method. Examples of an electrophotographic image forming apparatus include an electrophotographic copying machine, an electrophotographic printer (for example, laser printer, LED printer, etc.), a facsimile machine, a wordprocessor, a combination of two or more of the preceding apparatuses (multifunction printer, etc.), etc.

A process cartridge means: a cartridge in which a charging means, a developing means or a cleaning means, and an electrophotographic photoconductive member, are integrally disposed, and which is detachably mountable in the main assembly of an image forming apparatus; a cartridge in which a minimum of one among a charging means, a developing means, and cleaning means, and an electrophotographic photoconductive member, are integrally disposed, and which is detachably mountable in the main assembly of an image forming apparatus; or a cartridge in which a minimum of a developing apparatus and an electrophotographic photoconductive member are integrally disposed, and which is detachably mountable in the main assembly of an image forming apparatus.

A process cartridge system which has an electrophotographic photoconductive member, and a single or plurality of processing means which act on the electrophotographic photoconductive member, are integrally disposed in a cartridge detachably mountable in the main assembly of an image forming apparatus has long been employed by an electrophotographic image forming apparatus which uses an electrophotographic image forming process. According to a process cartridge system, an apparatus can be maintained by a user; and it is unnecessary to hire a service person. Thus, the employment of a cartridge system drastically improves the apparatus in operational efficiency. Therefore, a cartridge system has been widely used in the field of an image forming apparatus.

In the developing apparatus incorporated in such a process cartridge system, a sealing member for preventing leakage of developer toward the outside of a developing area is disposed at both ends of a rotating developer carrying member.

In the conventional image forming apparatus, an elastic member, such as felt or foamed rubber, has been utilized as the sealing member for preventing the developer leakage.

In addition to the elastic member, a magnetic material sealing member which has been multi-polarized to have N- and S-poles at its inner surface, has also been used.

The magnetic material sealing member has such a structure that it is disposed in a non-contact state with a predetermined spacing with a developer carrying member and prevents a developer from leaking from the developer carrying member under the action of a concentrated magnetic field created between the magnetic material sealing member and a magnet incorporated in the developer carrying member. The magnetic material sealing member is, different from the elastic member (felt or foamed rubber) described above, does not contact the developer carrying member, thus being advantageous in terms of prevention of an increase in torque and a deterioration of the sealing member.

Further, in recent years, a magnetic brush-type charging apparatus wherein electroconductive magnetic particles are held and carried to an image bearing member by a magnetic particle carrying member in which a magnet is disposed, a magnetic brush portion of the electroconductive magnetic particles magnetically forced to be held by the magnetic particle carrying member is caused to contact the image bearing member, and the magnetic particle carrying member is rotated to circulate and carry the magnetic brush portion to a contact portion with the image bearing member, thus charging the surface of the image bearing member, has been proposed. In such a charging apparatus, the magnetic material sealing member is also effective as a means for preventing leakage from lengthwise ends of the magnetic particle carrying member.

An example of a conventional magnetic material sealing member used in the conventional developing apparatus is shown in FIG. 24.

Referring to FIG. 24, at both ends of a developing roller 150 as the developer carrying member, a magnetic material sealing member 151 is disposed. Each magnetic material sealing member 151 is disposed opposite to an outer peripheral surface of the developing roller 150 with a predetermined gap g1. At an inner peripheral surface (opposite to the outer peripheral surface of the developing roller 150) of the magnetic material sealing member 151, a magnetic pole is disposed in a circumferential direction and creates a magnetic brush at the gap g1, thus preventing toner (developer) from leaking from the lengthwise ends of the developing roller 150.

FIG. 25 is a perspective view showing a detailed structure of the magnetic material sealing member 151. As shown in FIG. 25, the magnetic material sealing member 151 includes an arcuate portion 151*a* (half-round portion) providing the gap g1 (shown in FIG. 24) with the developing roller 150 at its inner peripheral surface, and an end portion (non-arcuate portion) 151*b* which extends linearly upward from an upper end of the arcuate portion 151*a* and has a rectangular cross section. On the end portion 151*b*, an arcuate surface 151*c* is formed and is flush with a retracted front surface 151*d* and a bent portion which has a rectangular cross section extending in a lengthwise direction (axis direction) of the developing roller 151. The end portion 151*b* and the bent portion 151*e* are disposed perpendicular to each other, and the bent portion 151*e* extends in a direction of the end of the developing roller.

The magnetic material sealing member 151 is provided with an elastic lining 152 formed of an elastic material such as a rubber on an outer peripheral surface side (backside). The elastic lining 152 has a width substantially equal to that of the magnetic material sealing member 151 in a direction parallel with the lengthwise direction of the developing roller. A lower end surface 152*f* of the elastic lining 152 is substantially flush with a lower end surface 151*f* of the magnetic material sealing member 151, and an upper end surface 152*g* of the elastic lining 152 is substantially flush with an upper end surface 151*g* of the magnetic material sealing member 151.

The elastic lining 152 is adhered to the backside of the magnetic material sealing member 151 with the use of double-faced adhesive tape.

Next, a mounting method of the magnetic material sealing member 151 to a developing means frame 153 will be described.

Further, the developing means frame 153 is provided with a mounting groove 154 for mounting the magnetic material sealing member 151, which groove extends from a flat surface 153*i* to an arcuate surface 153*j* as shown in FIG. 26. The groove 154 includes an arcuate groove 154*a* extended along an arcuation of the arcuate surface 153*j*, a linear groove 154*b* formed substantially vertically along the flat surface 153*j*, and a positioning groove 154*d*, formed in the longitudinal direction of the magnetic material sealing member 151, with which the bent portion 151*e* of the magnetic material sealing member 151 is engaged. A depth of the positioning groove 154*d* is equal to a width w1 (FIG. 25) of the bent portion 151*e* of the magnetic material sealing member 151. A depth of the linear groove 154*b* for mounting the end portion 151*b* (FIG. 25) of the magnetic material sealing member 151, smaller than the width w1 of the bent portion 151*e* plus the thickness of the elastic lining 152 by a compression margin of the elastic lining 152. Further, a lower end surface 154*f* and an upper end surface 154*g* of the arcuate groove 154*a* are located so that they contact the lower end surface 151*f* and the upper end surface 151*g* of the magnetic material sealing member 151, respectively, in a state that the magnetic material sealing member 151 is engaged in the mounting groove 154 for mounting the magnetic material sealing member 151.

As shown in (a) of FIG. 27, the magnetic material sealing member 151 is moved to the mounting groove 154 of the developing means frame 153 as indicated by an arrow b. Then, the semicircular arcuate portion 151*a* of the magnetic material sealing member 151 is fitted into the arcuate groove 154*a*, and the linear end portion 151*b* is fitted into the linear groove 154*b*, as shown in (b) of FIG. 27. When the magnetic material sealing member 151 is pressed in a direction of an arrow c, a lower portion 152*a* of the elastic lining 152 is compressed. At the same time, the lower end surface 151*f* of the magnetic material sealing member 151 presses the lower end surface 154*f* of the groove 154, and an upper end surface 151*g* of the magnetic material sealing member 151 is fitted to an upper end surface 154*g* of the groove 154. Accordingly, when the upper portion of the magnetic material sealing member 151 is pushed toward the rear side in a direction of an arrow d crossing the arrow c, the magnetic material sealing member 151 is engaged with the mounting groove 154.

After the magnetic material sealing member 151 is mounted into the mounting groove 154, as shown in (a) of FIG. 28, a developing blade 155 as a developer regulation member for regulating a toner layer thickness on the developing roller 150 is fastened to the developing means frame 153 with screws. The developing blade 155 includes an elastic, member 155*a* and a supporting plate 155*b*. The elastic member 155*a* abuts on the developing roller 150 while being curved. The magnetic material sealing member 151 is urged toward the supporting plate 155*b* side of the developing blade 155 by a repulsive force of the elastic lining 152.

In order to to prevent leak between the magnetic material sealing member 151 and the supporting plate 155*b* of the developing blade 155, a non-electroconductive insulating member 56 is disposed therebetween so as to ensure electric insulation.

Alternatively, as shown in (b) of FIG. 28, the supporting plate 155*b* and the magnetic material sealing member 151 are caused to contact each other and an electroconductive member 157 is disposed between the developing roller 150 and the supporting plate 155*b* are connected, thus being placed in an electrically equipotential state. As a result, the leak phenomenon is prevented.

However, in the conventional developing apparatus using the magnetic material sealing member, the mounting of the magnetic material sealing member to the developing means frame requires such procedual steps that the magnetic material sealing member is rotated in a direction of an arrow e shown in (b) of FIG. 27 until the lower end surface 151*f* of the magnetic material sealing member contacts the lower end surface 154*f* of the mounting groove by applying a force not less than the sum of the repulsive force by the elastic lining and the frictional force with the developing means frame, and then is lightly pressed in the direction of the arrow c to somewhat deform the developing means frame and at the same time is pressed in the direction of the arrow d. Accordingly, the mounting of the magnetic material sealing member is accompanied with a poor workability.

The workability is also lowered by the adhesion operation of the elastic lining to the semicircular arcuate portion 151*a*.

Further, it is necessary to use the insulating member 156 only for the purpose of leak prevention or the electroconductive member 157 only for providing equipotential to the magnetic material sealing member 151, the developing blade 155, and the developing roller 150. As a result, the number of constituent parts is increased and the structure of the developing apparatus becomes complicated.

SUMMARY OF THE INVENTION

In view of the above-described problems, the present invention has been accomplished.

An object of the present invention is to provide a developing apparatus capable of improving mounting workability and a magnetic material sealing member used in the developing apparatus.

Another object of the present invention is to provide a capability of solving a leak problem without using parts only for the purpose of leak prevention, and a magnetic material sealing member used in the developing apparatus.

According to the present invention, there is provided a developing apparatus, comprising:

a developing container for containing a developer;

a developer carrying member while carrying the developer thereon, the developer carrying member being provided in an opening portion of the developer container; and a sealing member which extends in a circumferential direction of the developer carrying member in the vicinity of an end of the developer carrying member and regulates movement of the developer toward the end of the developer carrying member by a magnetic force, the sealing member including an arcuate portion extended along a peripheral surface of the developer carrying member and a non-arcuate portion disposed at an end, in the circumferential direction, of the arcuate portion;

wherein an end surface of the arcuate portion of the sealing member on a side where the non-arcuate portion is not provided, is inclined such that a phantom plane including the end surface is closer to the arcuate portion than a center of arcuation of the arcuate portion.

According to the present invention, there is also provided a sealing member for sealing magnetic particles, comprising:

an arcuate portion extended opposite to a peripheral surface of a rotation member for carrying magnetic particles, a non-arcuate portion disposed at an end, in the circumferential direction, of the arcuate portion;

wherein an end surface of the arcuate portion of the sealing member on a side where the non-arcuate portion is not provided, is inclined such that a phantom plane including the end surface is closer to the arcuate portion than a center of arcuation of the arcuate portion.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, embodiments of the present invention, will be described in more detail with reference to the appended drawings.

In the following description of the present invention, the lengthwise direction of a process cartridge means the direction (axial direction of an image bearing member) intersectional (roughly perpendicular) to the direction in which a process cartridge is mounted into, or removed from, the main assembly of an image forming apparatus. It is parallel with to the surface of recording medium, and is intersectional (roughly perpendicular) to the direction in which the recording medium is conveyed. The right or left direction means the right or left direction of the recording medium as the recording medium is seen from the rear side in terms of the recording medium conveyance direction. The top surface of a process cartridge means the surface of the process cartridge which will be on the top side after the proper mounting of the process cartridge in the main assembly of an image forming apparatus, and the bottom surface of the process cartridge means the surface of the process cartridge which will be on the bottom side after the proper mounting of the process cartridge in the apparatus main assembly.

Embodiment 1

Embodiment 1 will be described with reference to FIGS. 1 and 2.

Figure 1:
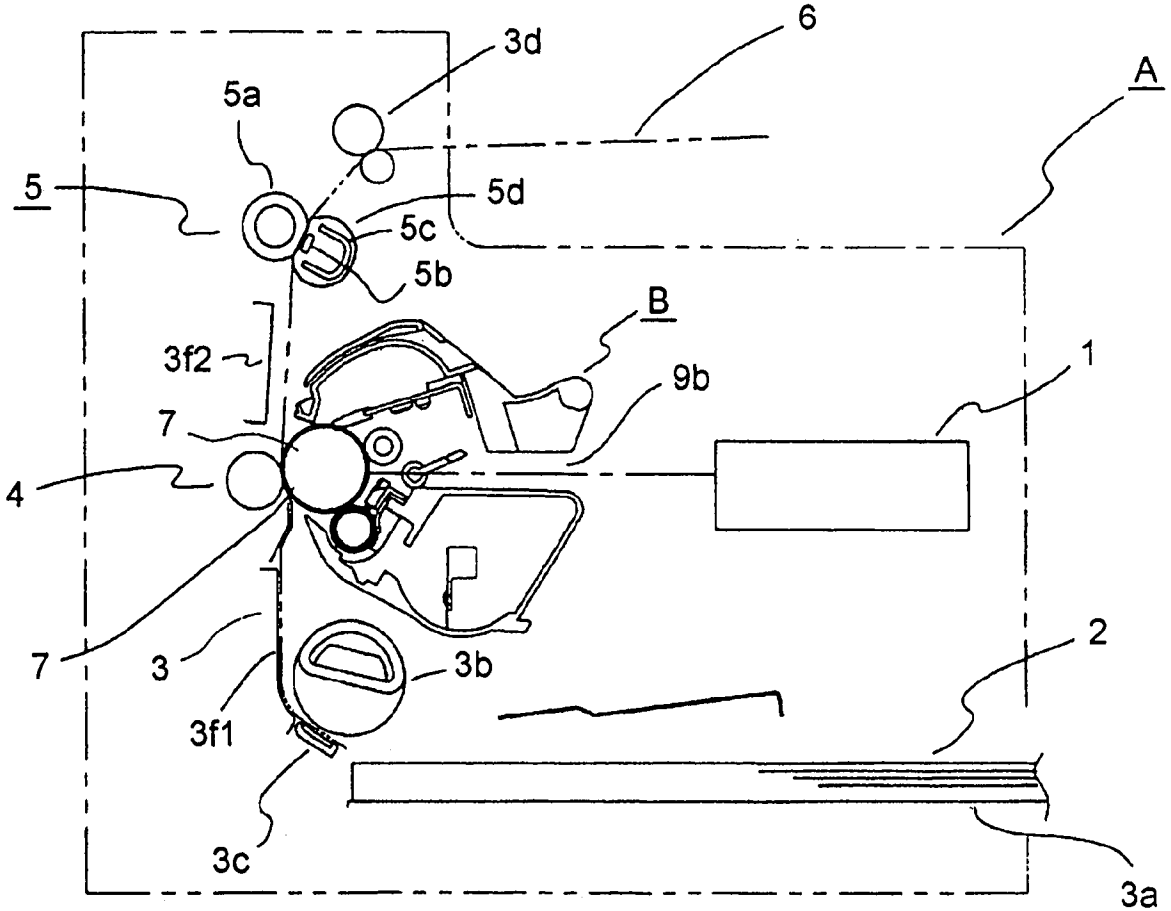
FIG. 1 is a schematic sectional view of an electrophotographic image forming apparatus, in which a process cartridge in accordance with the present invention has been mounted, describing the general structure thereof.

FIG. 1 is a schematic drawing for describing the structure of an electrophotographic image forming apparatus, in which a process cartridge is mounted. FIG. 2 is a schematic drawing for describing the structure of the process cartridge.

As for the order of description, the general structure of the process cartridge and the general structure of the electrophotographic image forming apparatus employing the process cartridge will be first described. Then, the-detailed structure of the developing apparatus according to the present invention will be described.

(General Structure)

Referring to FIG. 1, the electrophotographic image forming apparatus A (which hereinafter will be referred to simply as "image forming apparatus") in this embodiment is a laser beam printer, and has an electrophotographic photosensitive member 7 in the form of a drum (which hereinafter will be referred to simply as "photosensitive drum"), as an image bearing member.

A beam of light carrying image formation information is projected onto the photosensitive drum 7 from an optical system (exposure apparatus) 1, forming a latent image on the photosensitive drum 7. This latent image is developed into a toner image with the use of developer (which hereinafter may be referred to as "toner").

In synchronism with the formation of the toner image, a single or plurality of sheets of recording medium 2 (recording sheet, OHP film, cloth, etc.) in a sheet feeder cassette 3*a* are fed one by one into the apparatus main assembly by the combination of a pickup roller 3*b*, and a pressing member 3*c* kept pressed against the pickup roller 3*b*, and are conveyed further inward along a conveying guide 3*f*1.

The toner image formed on the photosensitive drum 7 in a process cartridge B is transferred onto the recording medium 2 by applying voltage to a transfer roller 4 as a transferring means. Then, the recording medium 2 is conveyed to a fixing means 5 by a conveying guide 3*f*2.

The fixing means 5 comprises: a driving roller 5*a*, a heater 5*b*, a supporting member 5*c*, and a rotational fixing member 5*d*. The rotational fixing member 5*d* is a cylinder formed of sheet of a certain substance, and is supported by the supporting member 5*c*. The heater 5*b* is in the hollow of the rotational fixing member 5*d*. The fixing means 5 fixes the unfixed toner image on the recording medium 2 to the recording medium 2, by the application of heat and pressure to the recording medium 2 while the recording medium 2 is passed through the fixing means 5. After the fixation, the recording medium 2 is further conveyed and discharged into the delivery area 6 through a reverse conveyance passage, by a pair of discharge rollers 3*d*.

In this embodiment, a conveyance means 3 is constituted by the pickup roller 3*b*, the pressing member 3*c*, the discharge rollers, etc.

(Process Cartridge)

On the other hand, the process cartridge B comprises an electrophotographic photoconductive member, and a minimum of one processing means. As for the processing means, there are, for example, a charging means for charging the electrophotographic photoconductive member, and a developing means for developing a latent image formed on the electrophotographic member, and a cleaning means for cleaning the toner remaining on the electrophotographic photosensitive member.

Figure 2:
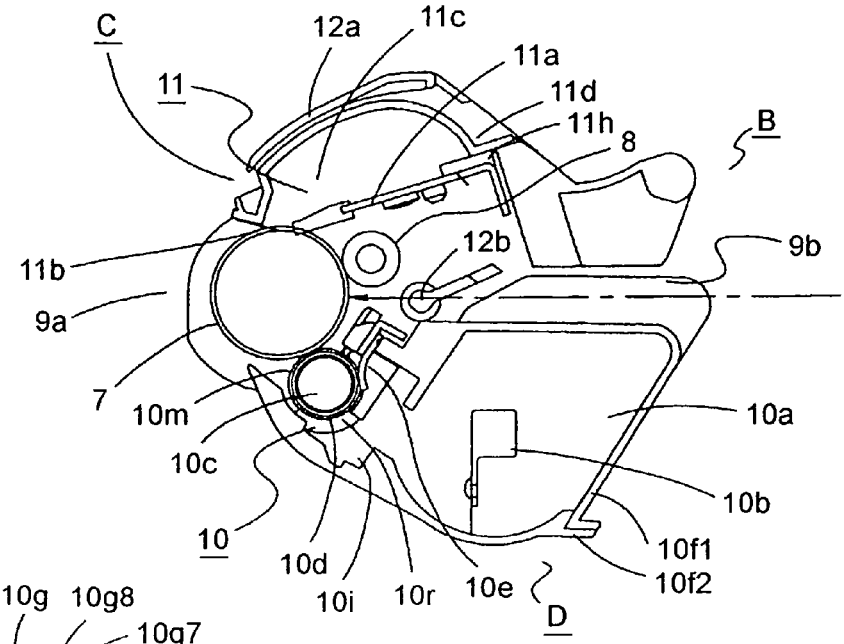
FIG. 2 is a schematic sectional view of the process cartridge describing the structure thereof.

Referring to FIGS. 1 and 2, the process cartridge B in this embodiment comprises the photosensitive drum 7, as an electrophotographic photosensitive drum, having a photoconductive layer, a charge roller 8 as a charging means, a developing means 10, and an exposure opening 9. In operation, while the photosensitive drum 7 is rotated, the peripheral surface of the photosensitive drum 7 is uniformly charged by the application of voltage to the charge roller 8, and the uniformly charged portion of the peripheral surface of the photosensitive drum 7 is exposed to information light (an optical image) projected from the optical system 1, forming a latent image. Then, the latent image is developed by the developing means 10.

(Developing Apparatus)

Figure 3:
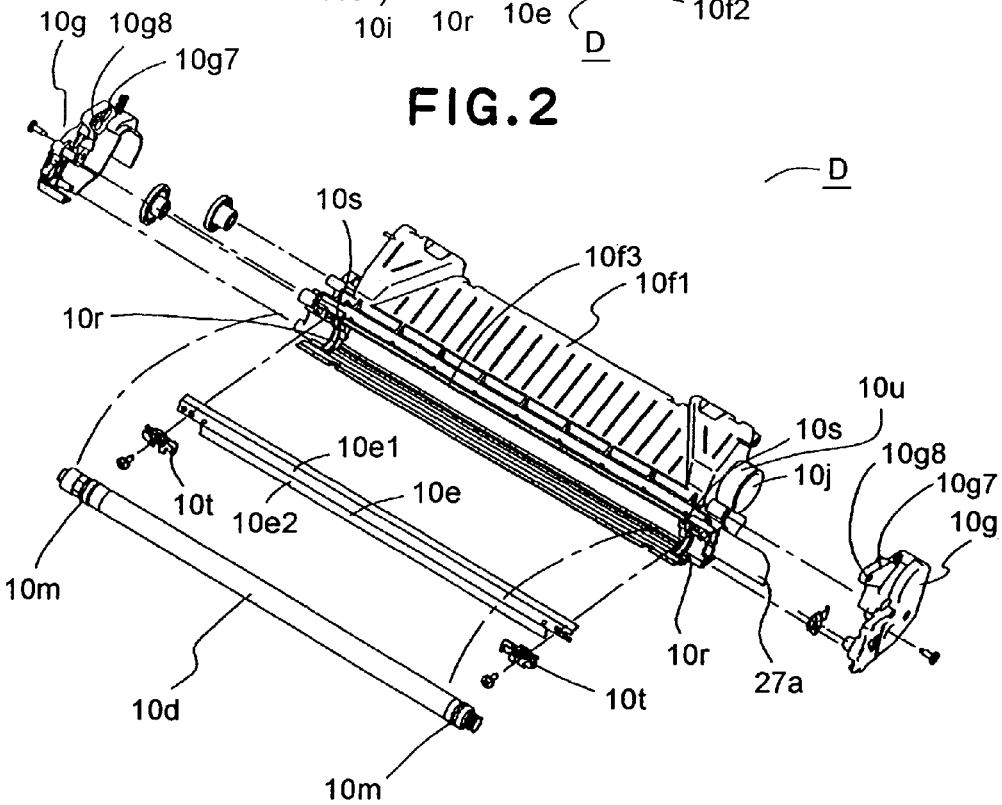
FIG. 3 is an exploded perspective view of the developing apparatus of the present invention.

The developing apparatus D includes, as shown in FIG. 3, a first developing means frame 10*f*1 forming a toner storage portion 10*a*, a second developing means frame 10*f*2, an end member 10*g*, parts for supplying power to a developing roller 10*d* as a developer carrying member, the developing roller 10*d*, a developing blade 10*e* as a developer regulation member for regulating a thickness of a layer of developer on the developing roller 10*d*, a magnetic material sealing member 10*r* for preventing toner from leaking from both end portions of the developing roller 10*d*, etc.

In the developing apparatus, toner stored in the toner storage portion is fed by a rotatable feeding member 10*b* as a toner feeding means. Then, the developing roller 10*d* containing a fixed magnet 10*c* is rotated and a layer of triboelectrically charged toner is formed on the surface of the developing roller 10*d*. The toner is then transferred onto the surface of the photosensitive drum in the pattern of the latent image to develop the latent image into a visual image, i.e., a toner image.

The first developing means frame 10*f*1 is rotatably supported by a cleaning means frame 11*d* so that the developing roller 10*d* of the developing apparatus D is oppositely disposed in parallel with the photosensitive drum 7 with a predetermined gap, and a gap-holding member 10*m* for holding the gap between the developing roller 10*d* and the photosensitive drum 7 is disposed at both end portions of the developing roller 10*d*.

Further, as shown in FIG. 3, at both side surfaces of the first developing means frame 10*f*1, the end member (holder member) 10*g* is disposed. The end member 10*g* is provided with an arm portion 10*g*7 having an engaging hole for rotatably hanging the developing means frame 10*f*1 with respect to the cleaning apparatus described later.

The toner storage portion 10*a* and a developing chamber 10*i* are formed by connecting the first developing means frame 10*f*1 and the second developing means frame 10*f*2 to each other. The developing means frame according to the present invention comprises the first developing means frame 10*f*1 and the second developing means frame 10*f*2.

Figure 4:
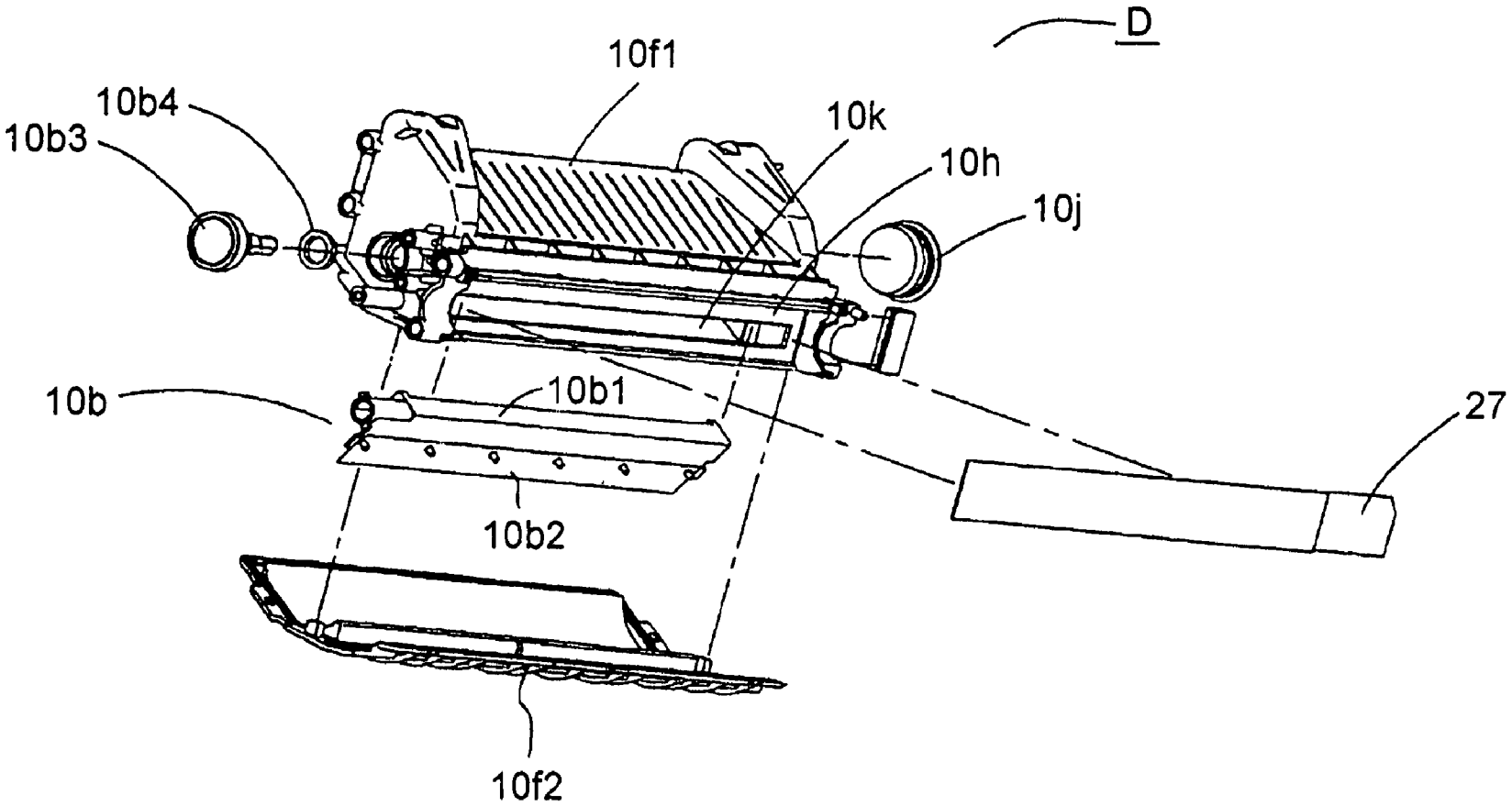
FIG. 4 is another exploded perspective view of the developing apparatus of the present invention.
Figure 5:
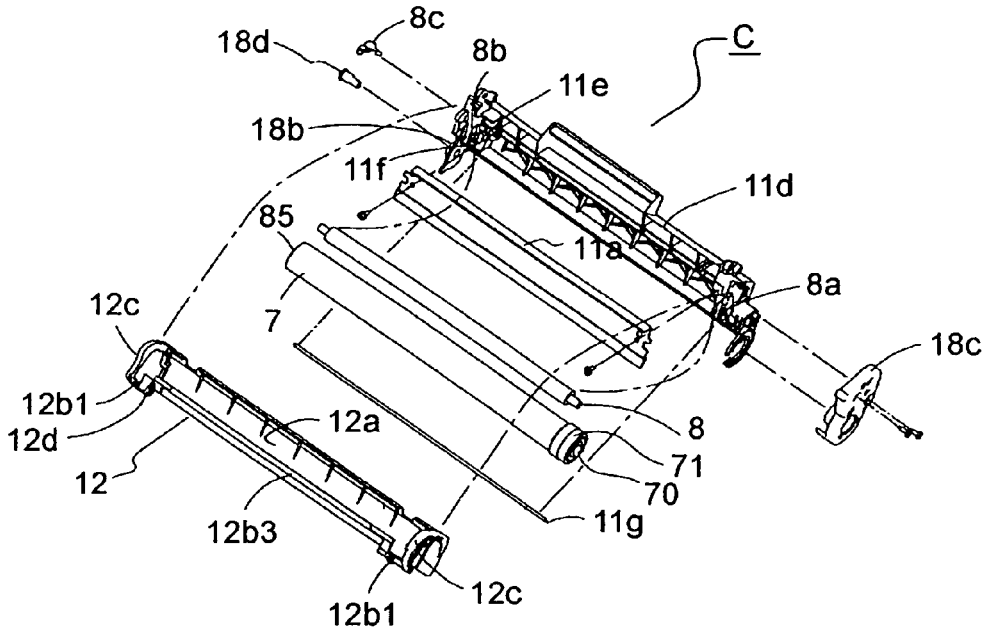
FIG. 5 is an exploded perspective view of the drum frame unit of the process cartridge in accordance with the present invention.

The first developing means frame 10*f*1 includes, as shown in FIG. 4, a stirring shaft 10*b*1 for supplying the toner and a sheet member 10*b*2 fixed to the stirring shaft 10*b*1. At an end of the stirring shaft 10*b*1, a conveyance gear 10*b*3 for regulating movement of the stirring shaft 10*b*1 in a lengthwise direction and receiving a driving force, and a sealing member 10*b*4 for preventing the toner from leaking toward the outside of the first developing means frame 10*f*1 are connected to the stirring shaft 10*b*1.

The first developing means frame 10*f*1 is provided with a toner passage opening 10*k* through which the toner stored in the toner storage portion 10*a* passes at the time of being fed to the developing roller 10*d*.

Further, as shown in FIG. 4, a toner sealing member 27 is heat-fixed to a seal mounting portion 10*h* along four edges of the toner passage opening 10*k*. At one end portion of the first developing means frame 10*f*1 in the lengthwise direction, as shown in FIG. 3, a toner filling port 10*u* for filling toner in the toner storage portion 10*a* is disposed and sealed with a cap member 10*j* after toner filling.

The developing apparatus D feeds the toner stored in the toner storage portion 10*a* by the feeding member 10*b* and forms a toner layer on the developing roller 10*d* by a magnetic force of the fixed magnet 10*e*, followed by development of the latent image formed on the photosensitive drum 7 with the toner by application of a developing bias voltage to form a visual (toner) image.

This toner image is transferred onto the recording medium 2 by applying a voltage of a polarity opposite to that of the toner image to the transfer roller 4.

The structure of the toner sealing member at the ends of the developing roller 10*d* in the lengthwise direction will be described in detail later.

(Cleaning Apparatus)

A cleaning apparatus C will be described in detail with reference to FIGS. 2, 5, 6 and 7.

The toner image developed by the developing means as described above is transferred onto the recording medium at the developing portion. The toner remaining on the photosensitive drum after the transfer is removed and recovered by the cleaning means 11 by scraping the toner with a cleaning blade 11*a* and scooping the toner with a scooping sheet 11*b* to be collected in a removal toner storage portion 11*c*.

The cleaning means 11 is a means for removing and recovering the toner remaining on the photosensitive drum 7 after the transfer operation. As the removal means, the cleaning blade 11*a*, the scooping sheet 11*b*, and the removal toner storage portion 11*c* described above are used. As the recovery means, a first sealing member 11*e* for preventing leakage of the toner from the backside of the cleaning blade 11*a* at both end portions and a second sealing member 11*h* for preventing the toner leakage from the backside of the cleaning blade 11*a* are fixed at a predetermined position of the cleaning means frame 11*d* with double-faced adhesive tape or the like.

Then, the cleaning blade is fixed at a predetermined position of the cleaning means frame 11*d* with screws. Further, a third sealing member 11*f* for preventing the toner leakage from both ends of a rubber of the cleaning blade 11*a* and being as a wiping member for wiping attachments such as toner particles on the photosensitive drum, and the scooping sheet 11*b* are adhesively fixed to the cleaning means frame 11*d* with double-faced adhesive tape or the like.

The cleaning apparatus C includes the above-mentioned cleaning means 11, the photosensitive drum 7, a drum shutter 12, an electrode 8*a* for supplying a voltage from the main assembly of the image forming apparatus A to a charge roller 8, a roller bearing 8*b* for supplying a voltage to the charge roller 8 through the electrode 8*a*, the other roller bearing 8*a*, etc.

The electrode 8*c* is engaged in the cleaning means frame 11*d*, and the roller bearings 8*a* and 8*b* are incorporated in the cleaning means frame 11*d*. Further, a shaft portion of the charge roller 8 is engaged in the bearings 8*a* and 8*b*.

In this embodiment, the process cartridge B includes the cleaning apparatus C for rotatably supporting the photosensitive drum and the developing apparatus D for developing the latent image on the photosensitive drum into a visual image.

Between the developing apparatus D and the cleaning apparatus C, a predetermined pressing force is exerted for keeping a spacing.

The photosensitive drum 7 is connected, at one end, with a drum gear 71 integrally including a triangular coupling portion 70 for transmitting a driving force, gears for transmitting a driving force to the developing roller 10 and the transfer roller 4, an earth contact, etc., and, at the other end, is connected with a flange 85 having a bearing.

On the triangular coupling portion 70 side of the cleaning means frame 11*d*, a bearing 18*c* for the photosensitive drum 7 is connected with screws. Into the other side of the cleaning means frame 11*d*, a positioning pin 18*d* is inserted and held under pressure so as to be fitted in a positioning portion 18*b*.

In the process cartridge B of this embodiment, as shown in FIG. 2, the drum shutter 12 capable of integrally covering a transfer opening 9*a* and an exposure opening 9*b* disposed opposite to the transfer roller 4 for the photosensitive member 7 is provided rotatably to the cleaning means frame 11*d*.

(Drum Shutter)

The structure of the drum shutter 12 will be described.

The drum shutter 12 has a drum protection portion 12*a* capable of covering the transfer opening 9*a* where the photosensitive drum 7 contacts the transfer roller 4. To a rotation shaft 12*b* (FIG. 2) for rotatably supporting the drum shutter 12 in the vicinity of the charge roller 8 of the cleaning means frame 11*d*, sliding portions 12*b*1 which slide along the cleaning means frame 11*d* at both ends of the rotation shaft 12*b* and a connecting portion 12*b*3 for connecting the sliding portions is provided.

Figure 7:
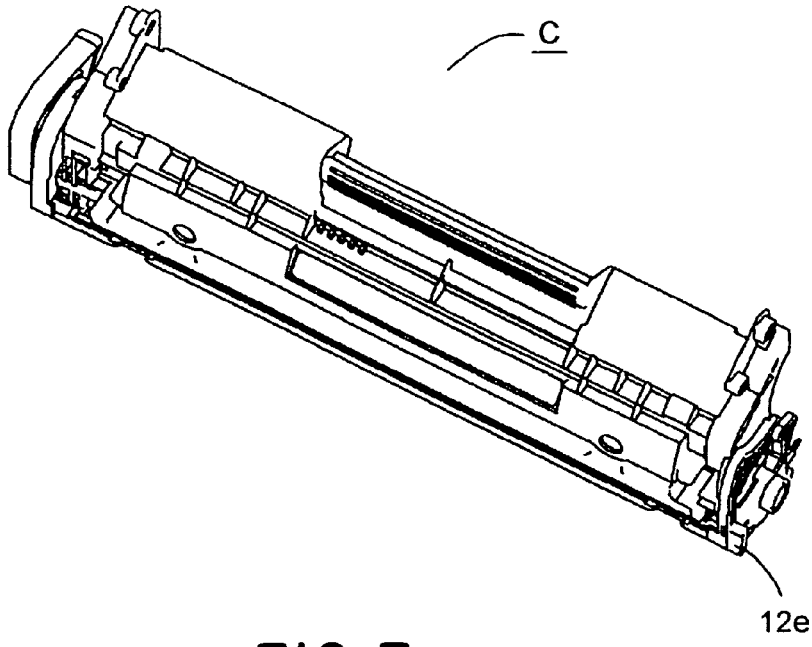
FIG. 7 is a perspective view of the cleaning apparatus.

The drum shutter 12 has coupler portions 12*c* disposed at longitudinal ends each at which the end portions of the drum protection portion 12*a* and the rotation shaft 12*b* are connected. A rib 12*e* is disposed outside of the rotation shaft 12*b*1 and provided to the right-side coupler portion 12*c* (FIG. 7). The rib 12*e* extends outward in the lengthwise direction of the drum shutter 12 and is carried by a shutter guide surface of the image forming apparatus main assembly, thus being retained in an open state.

Figure 6:
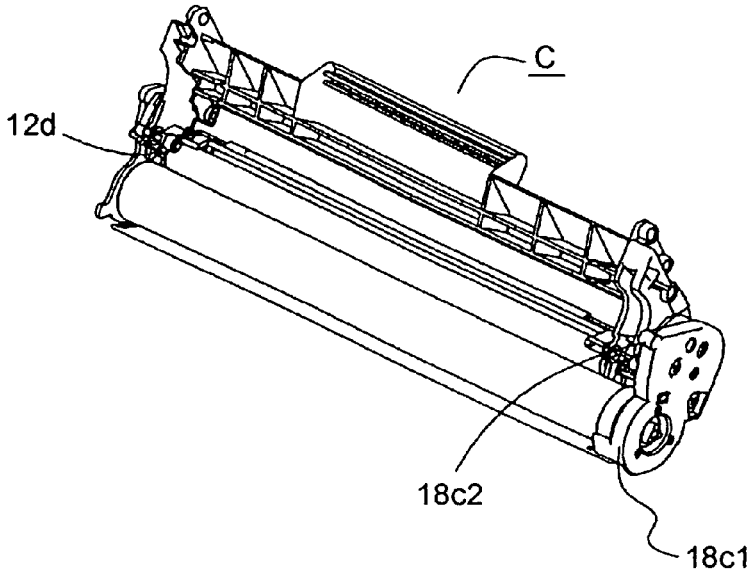
FIG. 6 is a perspective view of a cleaning apparatus.

To the drum shutter, an urging force is applied by a spring force of a shutter spring 12*d* in a direction such that the drum shutter 12 covers the photosensitive drum 7. By doing so, in such a state that the process cartridge B is removed from the apparatus main assembly, the drum shutter 12 is retained in such a closed state as shown in FIGS. 6 and 7 that it covers the transfer opening 9*a* of the photosensitive drum. On the other hand, in such a state that the process cartridge B is capable of effecting image forming operation in the apparatus main assembly, the drum shutter is rotated by a drum shutter opening/closing means on the image forming apparatus main assembly side to expose the transfer opening 9*a* as shown in FIGS. 1 and 2. As a result, the photosensitive drum 7 and the transfer roller 4 are placed in a contactable state.

(Magnetic material sealing member in display apparatus and mounting method thereof)

Figure 8:
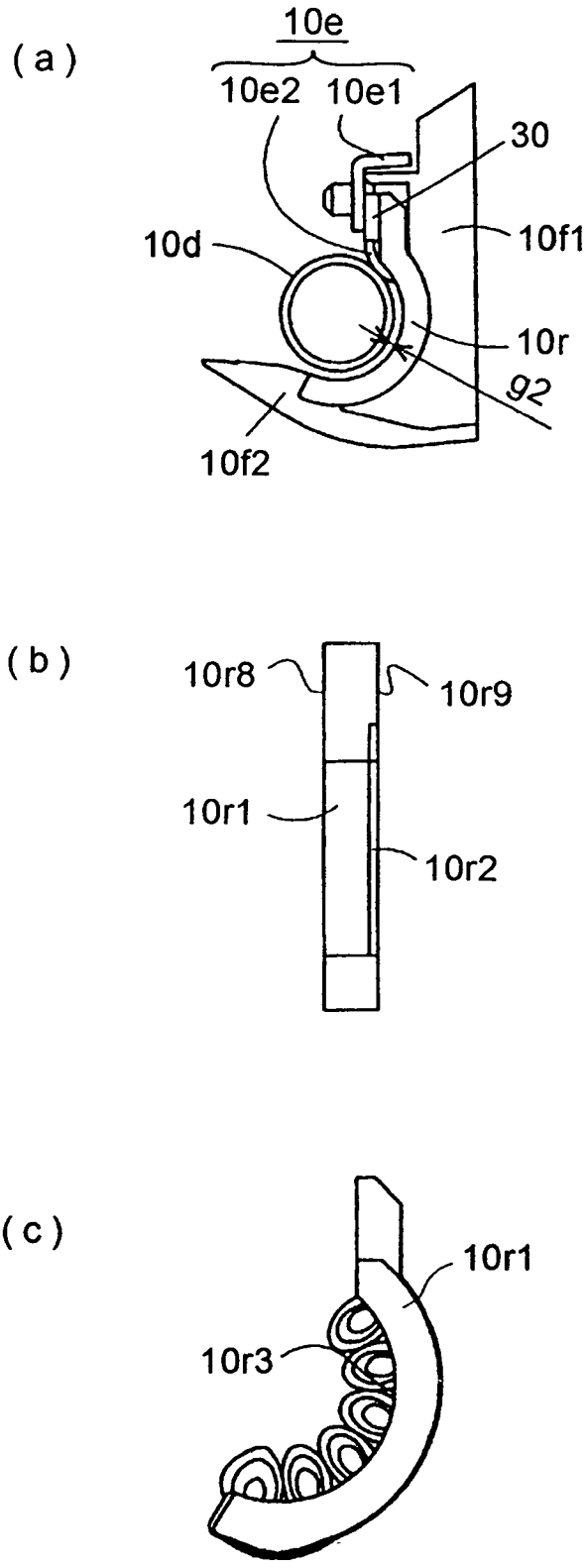
FIGS. 8(*a*), (*b*) and (*c*) are explanatory views of the magnetic material sealing member of the present invention.
Figure 9:
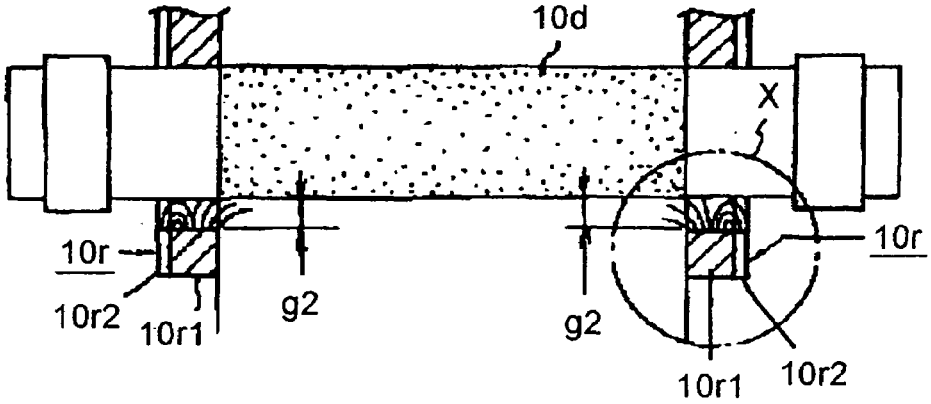
FIGS. 9(*a*) and (*b*) are views for illustrating a positional relationship between a magnet and a magnetic plate of the magnetic material sealing member.
Figure 9:
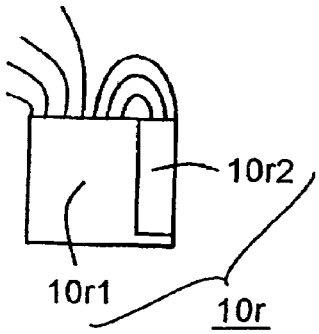

The structure of the magnetic material sealing member for preventing toner leakage in the above-described developing apparatus D will be described FIGS. 8-13. FIG. 8(*a*) is a sectional view showing a positional relationship among the first developing means frame 10*f*1, the second developing means frame 10*f*2, the developing roller 10*d*, the elastic member 30, and the magnetic material sealing member 10*r*; FIG. 8(*b*) is a perspective view of the magnetic material sealing member 10*r*; and FIG. 8(*c*) is an explanatory view showing a state of generation of a magnetic field at the magnetic material sealing member 10*r*. FIG. 9(*a*) is a view showing a positional relationship between a magnet 10*r*1 and a magnetic plate 10*r*2, and FIG. 9(*b*) is a partially enlarged view of FIG. 9(*a*) at X portion.

As shown in FIG. 8(*a*), the magnetic material sealing member 10*r*1 is mounted to the first and second developing means frames 10*f*1 and 10*f*2 and creates a gap g2 with the developing roller 10*d*.

Further, as shown in FIG. 8(*b*), at a side surface of the magnet 10*r*1 of the magnetic material sealing member 10*r* in a width direction (i.e., the lengthwise direction of the developing roller 10*d*), the magnetic plate r2 of a magnetic material is bonded. The magnet 10*r*1 constituting the magnetic material sealing member 10*r* is a 2.5 mm-wide injection molding product comprising a nylon resin binder containing Nd—Fe—B magnetic material powder, and the magnetic plate 10*r*2 bonded to the magnet 10*r*1 is formed of an iron material in a thickness of 0.5 mm. Both members are bonded to each other through insert molding as a type of injection molding.

Further, as shown in FIG. 8(*c*), at the inner peripheral surface 10*r*3 (opposite to the outer peripheral surface of the developing roller) of the magnet 10*r*1, a plurality of N- and S-poles are provided, whereby a chain of the magnetic brush is formed at the gap g2 between the magnet 10*r*1 and the developing roller 10*d*, thus preventing the toner from leaking from the end portion of the developing roller 10*d*. In this embodiment, the gap g2 is set to 0.1-10.7 mm, and a magnetic flux density by a magnetic force of the magnetic material sealing member 10*r* is about 1000-2000 Gs on the developing roller 10*d*.

With respect to the positional relationship between the magnet 10*r*1 and the magnetic plate 10*r*2 in the magnetic material sealing member 10*r*, as shown in FIG. 9(*a*), the magnet 10*r*1 is disposed on the opening side of the first developing means frame 10*f*1, and the magnetic plate 10*r*2 is disposed on the outer side than the opening side (both end sides of the developing roller 10*d* in the lengthwise direction).

As described above, by disposing the magnet 10*r*1 on the opening side of the first developing means frame 10*f*1 and disposing the magnetic plate 10*r*2 on the outer side than the opening side, magnetic lines of force of the magnetic material sealing member 10*r*, as shown in FIG. 9(*b*), are created between the magnet 10*r*1 and the magnetic plate 10*r*2 and enter the magnetic plate 10*r*2 having a higher permeability, so that magnetic lines of force extending toward the outside of the magnetic material sealing member 10*r* are not generated. As a result, it becomes possible to reliably hold the toner in an area where the surface of the magnetic material sealing member 10*r* exhibits a strong magnetic force. Accordingly, even if, e.g., an impact is given when the process cartridge B is mounted in or demounted from the image forming apparatus main assembly by a user, it is possible to ensure a good sealing performance without causing toner leakage.

Figure 10:
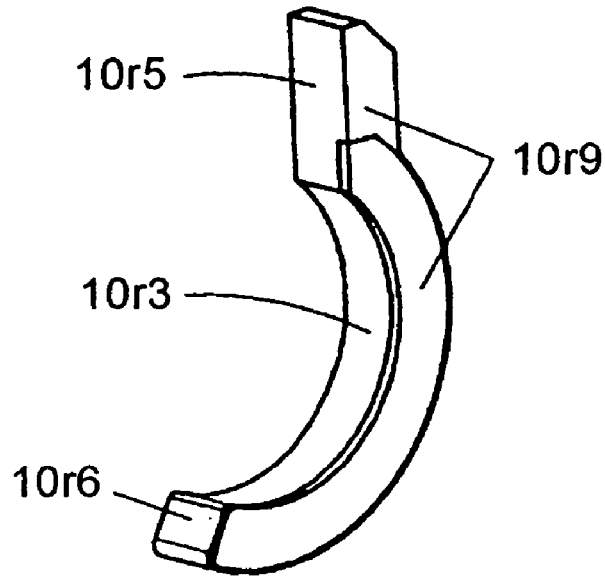
FIGS. 10(*a*) and (*b*) are perspective explanatory views of the magnetic material sealing member.
Figure 10:
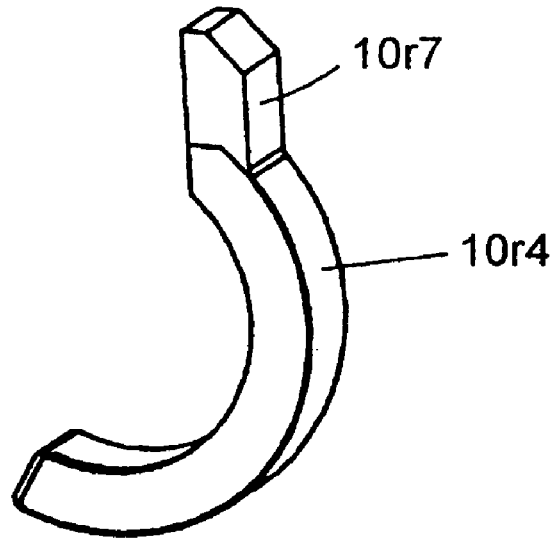
Figure 11:
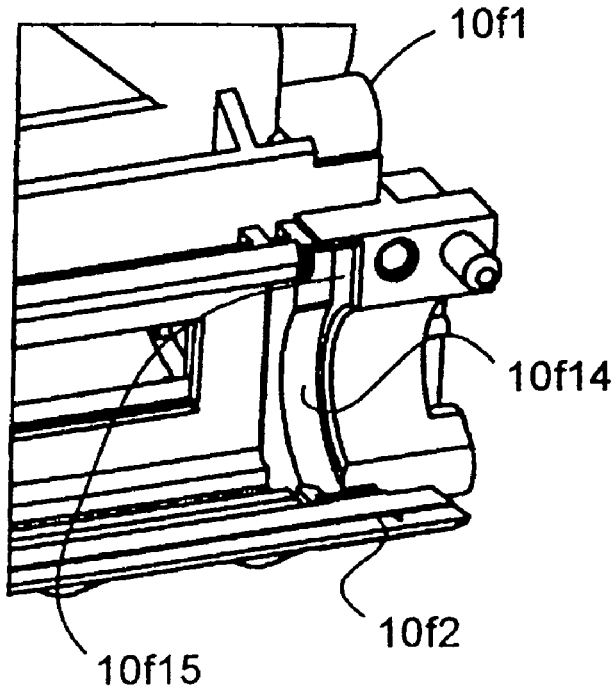
FIGS. 11(*a*) and (*b*) are perspective explanatory views of a mounting portion of the magnetic material sealing member.
Figure 11:
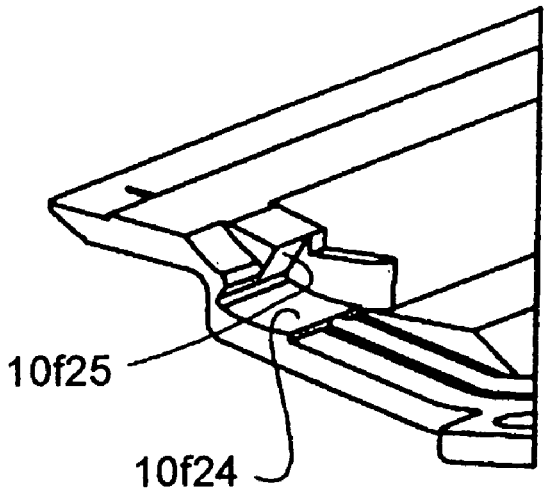
Figure 12:
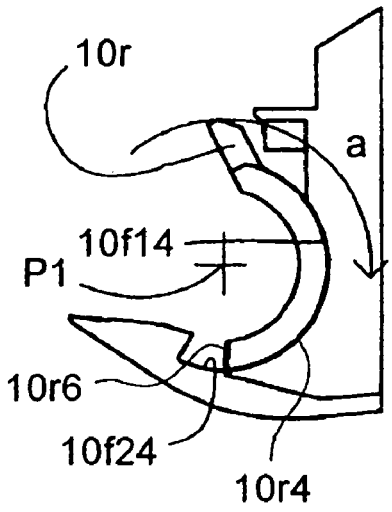
FIGS. 12(*a*) and (*b*) are sectional views for illustrating a mounting method of the magnetic material sealing member.
Figure 12:
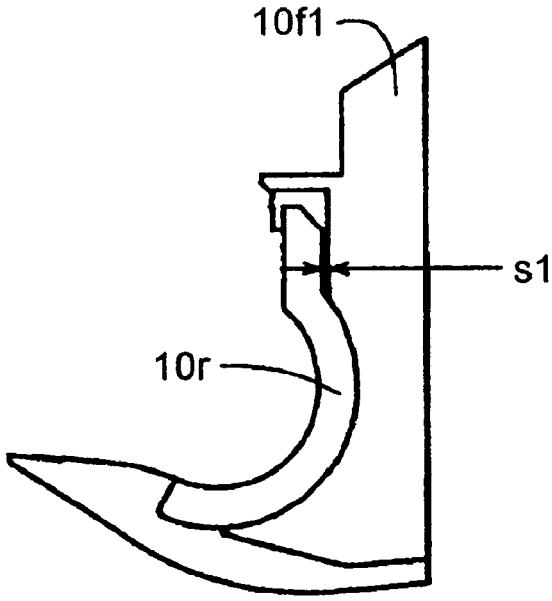
Figure 13:
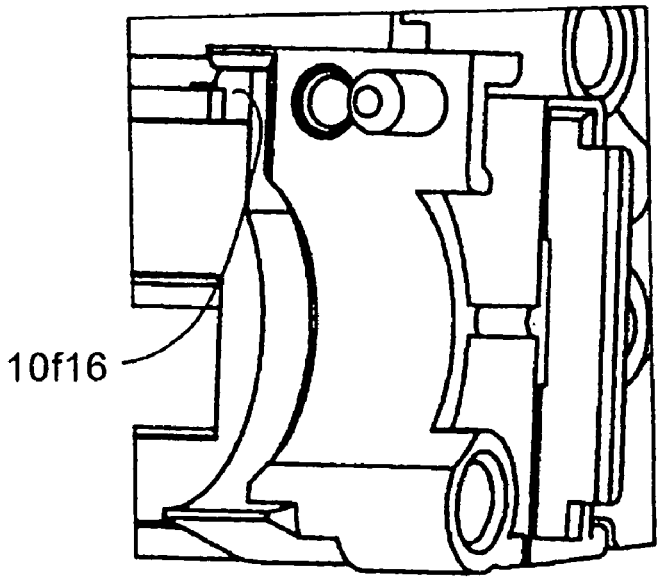
FIG. 13 is a perspective explanatory view of a magnetic material sealing member mounting portion of a first developing means frame.
Figure 14:
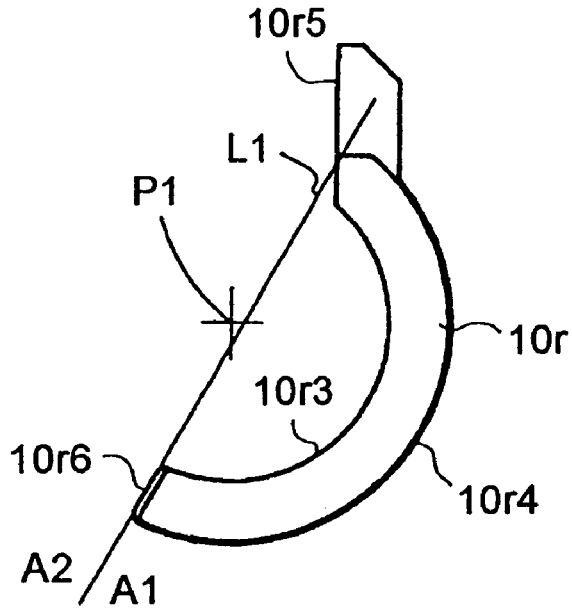
FIG. 14 is a schematic sectional view of the magnetic material sealing member for illustrating a frame abutting surface in a plane perpendicular to a lengthwise direction of the frame body.

Then, the mounting method of the magnetic material sealing member 10*r* will be described with reference to FIGS. 8 and 10-14. FIGS. 10(*a*) and 10(*b*) are perspective explanatory views of the magnetic material sealing member 10*r*; FIGS. 11(*a*) and 11(*b*) are perspective explanatory views of mounting portions of the magnetic material sealing member 10*r*; FIGS. 12(*a*) and 12(*b*) are sectional explanatory views of the mounting method of the magnetic material sealing member 10*r*; FIG. 13 is a perspective explanatory view of the magnetic material sealing member mounting portion of the first developing means frame; and FIG. 14 is a sectional explanatory view or describing a frame abutting end surface 10*r*6 of the magnetic material sealing member 10*r* in a plane perpendicular to the lengthwise direction of the frame.

As shown in FIGS. 8(*a*) and 10(*a*), the magnetic material sealing member 10*r* has the inner peripheral surface (the developing roller 10*d* side) in the form of a semicircular arc for creating the gap g2 with the developing roller 10*d*, and an outer contact surface 10*r*4, in a semicircular arc, which contacts the first developing means frame 10*f*1 and the seconds developing means frame 10*f*2 on the outer peripheral surface side located opposite from the inner peripheral surface 10*r*3 i.e., on the first and second developing means frame sides). The outer contact surface 10*r*4 is not provided with an elastic lining as in the conventional magnetic material sealing member but directly contacts grooves provided to the developing means frames.

Further, the magnetic material sealing member 10*r* has an elastic member abutting surface 10*r*5 (FIG. 10(*a*)) where a metal plate portion 10*e*1 (FIG. 8(*a*)) of the developing blade 10*e* attached to the first developing means frame 10*f*1 and the elastic member 30, which is to be compressedly disposed between the developing blade 10*e* and the magnetic material sealing member 10*r*, contact each other. As described above, the magnetic material sealing member 10*r* has the arcuate portions (10*r*3, 10*r*4) extended along the peripheral surface of the developing roller and the non-arcuate portions (10*r*5, 10*r*7) disposed on one end side of the arcuate portions, Further, on the other end side where the non-arcuate portions are disposed, the magnetic material sealing member 10*r* has a frame abutting surface 10*r*6 (FIG. 10(*a*)) for contacting the second developing means frame 10*f*2.

On the other hand, the first developing means frame 10*f*1 is provided with a mounting arcuate portion 10*f*14 for contacting the outer contact surface 10*r*4 of the magnetic material sealing member 10*r* as shown in FIG. 11(*a*).

Further, as shown in FIG. 11(*b*), the second developing means frame 10*f*2 is provided with a mounting arcuate portion 10*f*24 for contacting the outer contact surface 10*r*4 of the magnetic material sealing member 10*r* and a mounting end surface 10*f*25 for abutting on the frame abutting surface 10*r*6 of the magnetic material sealing member 10*r*. The magnetic material sealing member 10*r* is mounted in such a state that the first and second developing means frames 10*f*1 and 10*f*2 are connected to each other as shown in FIG. 8(*a*) but in FIG. 11(*b*), only the second developing means frame 10*f*2 is shown for the sake of easy explanation of the mounting end surface 10*f*25, thus omitting the first developing means frame 10*f*1.

When the magnetic material sealing member 10*r* is mounted in the developing means frame comprising the first and second developing means frames 10*f*1 and 10*f*2, as shown in FIG. 12(*a*), the magnetic material sealing member 10*r* is placed on the mounting arcuate portion 10*f*14 of the first developing means frame 10*f*1 until the outer contact surface 10*r*4 contacts the mounting arcuate portion 10*f*14 and then is rotated in a direction of an arrow a.

Then, as shown in FIG. 12(*b*), when the magnetic material sealing member 10*r* is rotated until its frame abutting end surface 10*r*6 runs against the mounting end surface 10*f*25 of the second developing means frame 10*f*2, the magnetic material sealing member 10*r* is located at a predetermined position.

Incidentally, in order to avoid contact between a backside surface 10*r*7 of the elastic member abutting surface 10*r*5 and the first developing means frame 10*f*1; a spacing S1 is provided. The spacing S1 is set to a value capable of accommodating shape and dimension errors as production of the second developing means frame 10*f*2 and the magnetic material sealing member 10*r*.

Further, side surfaces 10r8 and 10r9 (FIG. 8(*b*)) of the magnetic material sealing member 10r are inserted in a space between positioning surfaces 10f15 and 10f16 (FIGS. 11(*a*) and 13) of the first developing means frame 10f1, whereby positioning of the magnetic material sealing member 10r in the lengthwise direction of the developing roller is effected.

Then, the elastic member 30 is disposed at the elastic member abutting surface 10r5 of the magnetic material sealing member 10r. The elastic member 30 is attached to the elastic member abutting surface 10r5 with the use of adhesive means such as double-faced adhesive tape.

A sealing member 10s (FIG. 3) for preventing toner leakage from both end portions of the developing blade 10e is attached to the first and second developing means frames 10f1 and 10f2.

Further, as shown in FIG. 3, the developing blade 10e is secured at both end portions of the metal plate portion 10e1 to the first developing means frame 10f1 together with a scraping member 10t for scraping the toner at end portion of the developing roller 10d by screws. At this time, a tapered rib 10f3 disposed along the lengthwise direction of the first developing means frame 10f1 is set to have a dimension so that it always bites a developing blade rubber portion 10e2. As a result, the developing blade rubber portion 10e2 and the first developing means frame 10f1 are being left in a sealed state.

The thickness of the elastic member 30 is set to a value larger than an ordinary value by a compression margin in advance so as to create an elastic force at the magnetic material abutting surface 10r5 in such a state that the elastic member 30 is compressedly sandwiched between the metal plate portion 10e1 of the developing blade (layer thickness regulation member) 10e and the elastic member abutting surface 10r5 of the magnetic material sealing member 10r (FIG. 8(*a*)).

In this embodiment, a complicated operation as in the conventional developing apparatus is not required in the mounting step but a simple operation such that the magnetic material sealing member 10r is only rotated relative to the developing means frame (the first and second developing means frames) while contacting the developing means frame is effected.

A frictional resistance caused by friction between the developing means frame (polystyrene-based resin) and the magnetic material sealing member 10r is smaller than a resistance caused by compression and friction of the elastic lining as in the conventional developing apparatus. Further, the developing apparatus of the present invention is also advantageous than the conventional developing apparatus in terms of an operation force since, the magnetic material sealing member can be mounted in the developing means frame without deforming the developing means frame.

By the elastic force caused by the elastic member 30, a rotational force is exerted on the magnetic material sealing member 10r in the direction of the arrow a. The frame abutting surface 10r6 for preventing rotation in the arrow a direction is press fitted in the developing means frame so that the outer contact surface 10r4 is not separated from the mounting arcuate portion 10f14 of the first developing means frame 10f1 and the mounting arcuate portion 10f24 of the second developing means frame 10f2 by the rotational force.

The above mounting method will be described more specifically with reference to FIGS. 12(*a*) and 14.

Referring to these figures, a rotation center at the time of rotating the magnetic material sealing member 10r in the arrow a direction is indicated as P1. This rotation center P1 corresponds to the center of arcuation of the outer contact surface 10r4. On the other hand, as shown in FIG. 14, an extension line of the frame abutting end surface 10r6 is indicated as L1, and two areas partitioned by the line L1 are indicated as A1 and A2. The area A1 is located on the magnetic material sealing member 10r side, and the area A2 is located on the mounting end surface 10f25 side.

In this embodiment, the center P1 is located on the area A1 side, i.e., a phantom plane including the frame abutting end surface 10r6 is placed closer to the arcuate portion side than the center of arcuation of the arcuate portion of the magnetic material sealing member 10r, whereby the rotational force acts on the magnetic material sealing member 10r so that the magnetic material sealing member 10r is pressed toward the outer contact surface 10r4 side. Accordingly, the outer contact surface 10r4 of the magnetic material sealing member 10r is not separated from the mounting arcuate portions 10f14 and 10f24 of the first and second developing means frames 10f1 and 10f2. As a result, the gap g1 between the developing roller 10d and the magnetic material sealing member 10r is kept constant.

In the conventional developing apparatus, the elastic lining member is adhered to the outer peripheral surface of the arcuate portion of the magnetic material sealing member. On the other hand, in this embodiment, the elastic member 30 is adhered to a planar portion 10r5, so that an adhesive workability of the elastic member 30 is improved, thus facilitating a mounting performance.

Further, positioning of the magnetic material sealing member 10r is performed in a plane perpendicular to the lengthwise direction of the developing roller by the outer contact surface 10r4 and the frame abutting surface 10r6. Accordingly, it is not necessary to provide the magnetic material sealing member with a bent portion extending in the lengthwise direction of the developing roller as in the conventional developing apparatus. As a result, the developing device is made compact in the lengthwise direction and is also applicable to a developing means frame having a tight space in the lengthwise direction.

(Connection Between Developing Apparatus and Cleaning Apparatus)

Figure 15:
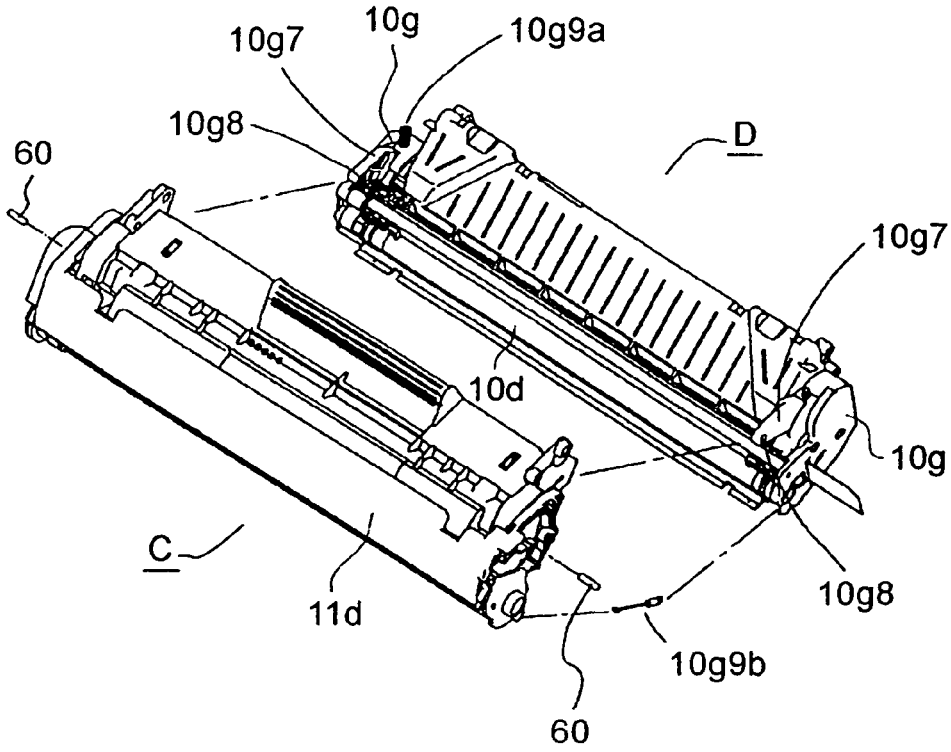
FIG. 15 is a perspective view showing a separation state of the developing apparatus and the cleaning apparatus.
Figure 16:
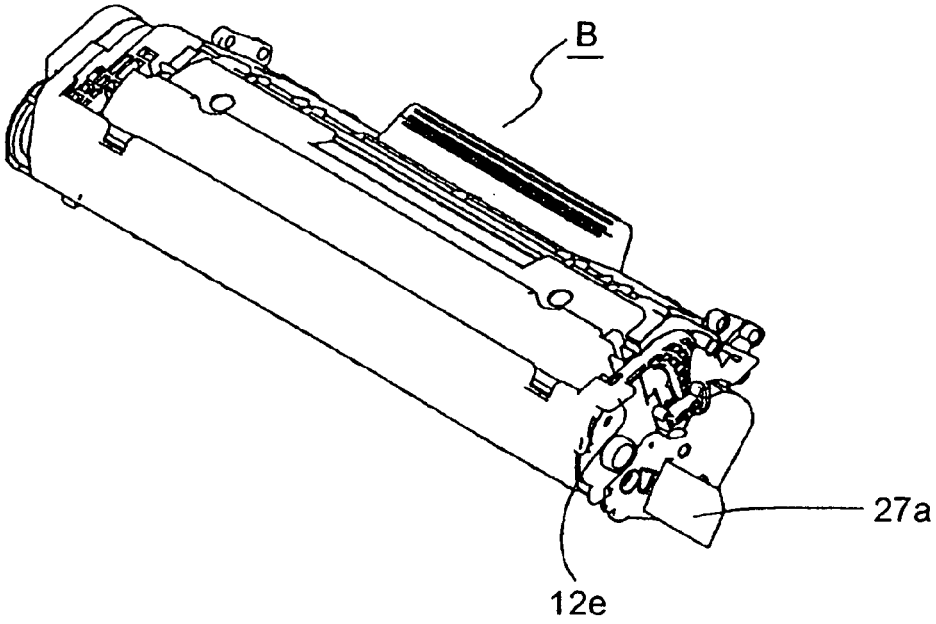
FIG. 16 is a perspective view showing a connection state of the developing apparatus and the cleaning apparatus.

Connection of the above-described developing apparatus D with the cleaning apparatus is performed in the following manner as shown in FIG. 15.

Referring to FIG. 15, each of two end members 10g provided to both ends of the developing means frame is provided with an arm-like portion 10g7, which protrudes toward the cleaning means frame 11d. The arm-like portion 10g7 has a hole 10g8, which is in the end portion of the arm-like portion 10g7, extending in the lengthwise direction of the process cartridge B. The cleaning means frame 11d and the end member 10g can be joined by putting a pin through the hole 10g8 of the arm-like portion of the end member 10g, and the unshown hole of the cleaning means frame 11d, so that they can be rotated about the pin. A compression coil spring 10g9a is placed in the compressed state between the arm-like portion 10g7 and cleaning means frame 11d, with one end of the compression coil spring 10g9a fitted around the spring holding portion 10g9 of the end member 10g and with the other end of a tension spring 10g9b having from the end member 10g to the cleaning means frame 11d. The end portions of the development roller 10d are fitted with gap maintaining members 10m, one for one, and the gap maintaining members 10m are pressed on the peripheral surface of the photoconductive drum 7.

Therefore, a predetermined distance is kept between the peripheral surfaces of the developing roller and the photosensitive drum 7. The above-described method completes the process cartridge B.

When a user purchases and uses the process cartridge B, the user holds and pulls out a toner sealing member end portion 27 to unseal the toner passage opening 10*k* of the first developing means frame 10*f*1, thus allowing feeding of the toner from the toner storage portion 10*a* to the developing chamber 10*i*. By doing so, the process cartridge B is ready for insertion thereof into the main assembly of the image forming apparatus A.

(Mounting and demounting of the process cartridge B, into and from, the image forming apparatus main assembly)

Figure 17:
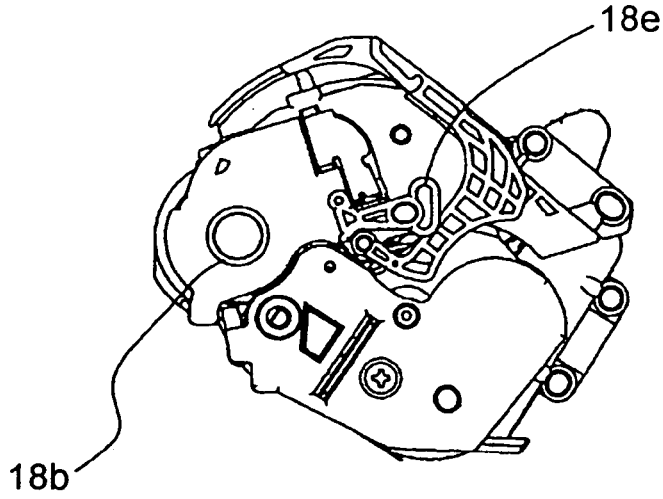
FIGS. 17(*a*) and (*b*) are explanatory side views of the process cartridge.
Figure 17:
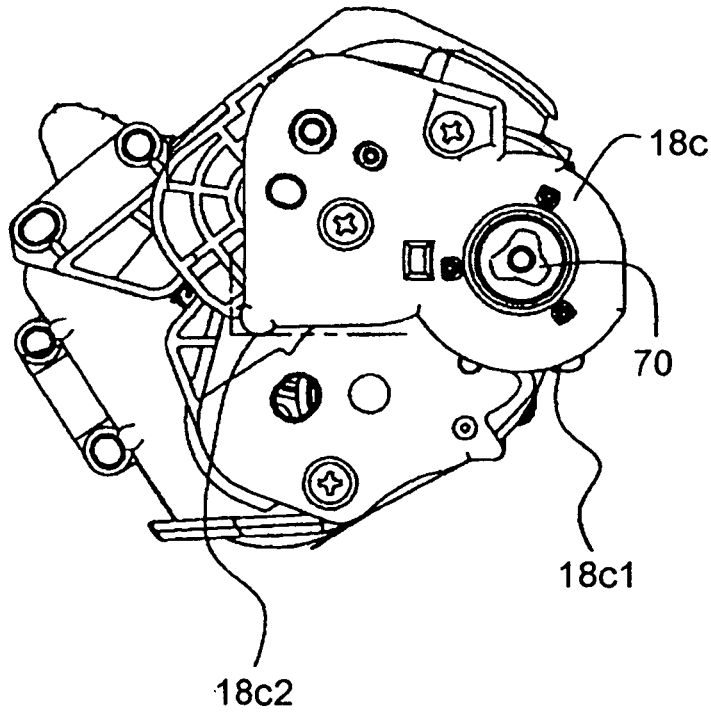
Figure 18:
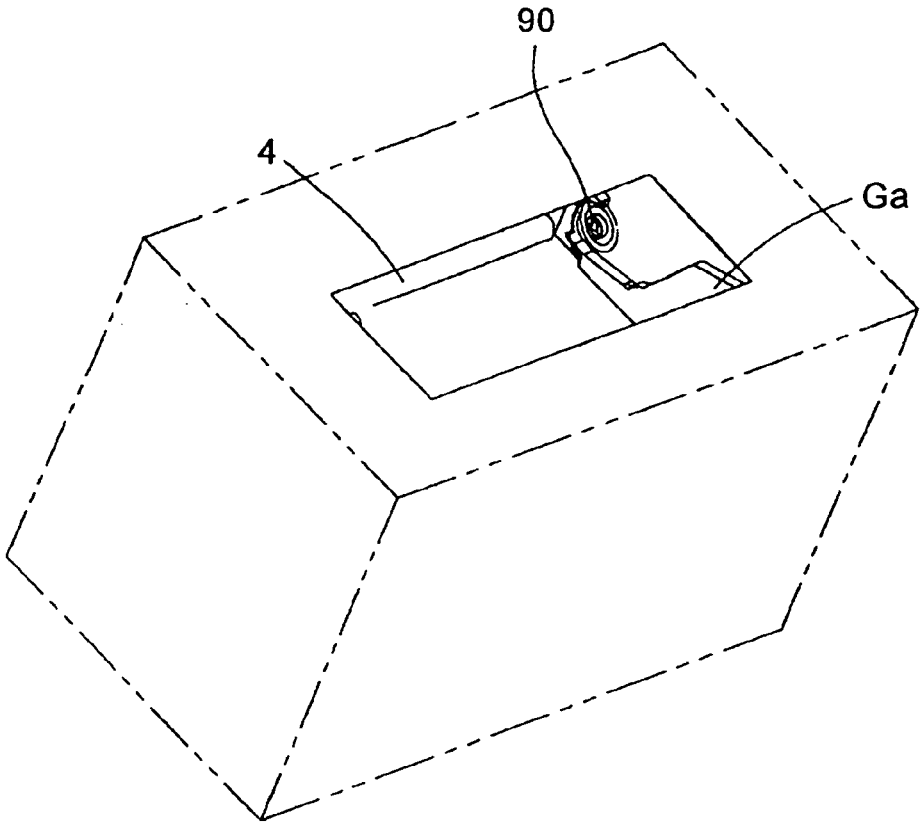
FIG. 18 is a drawing for describing a process cartridge mounting guide of a main assembly of the image forming apparatus.
Figure 19:
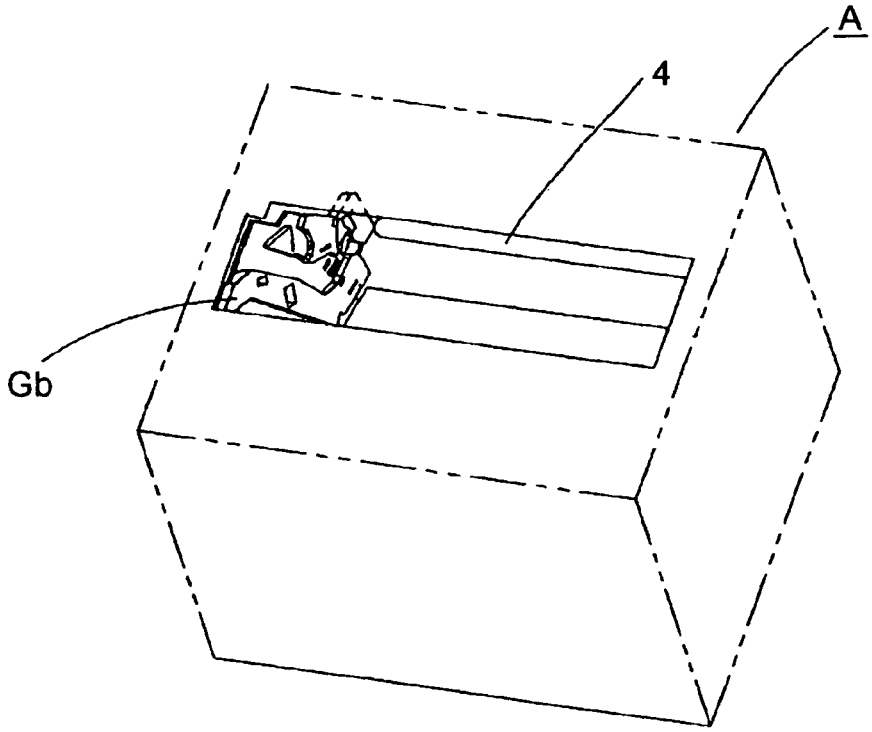
FIG. 19 is a drawing for describing a process cartridge mounting guide of a main assembly of the image forming apparatus.

When the above-assembled process cartridge B is mounted into and demounted (removed) from the main assembly of the image forming apparatus, as shown in FIGS. 17(*a*) and 17(*b*), an arcuate portion 10*c*1 and a rotation stopping portion 18*c*2 provided at one side surface of the process cartridge B (FIG. 17(*b*)) are guided along a guide member Ga (FIG. 18) as a mounting means provided to the apparatus main assembly, and a positioning portion 18*b* and a projection 18*e* provided at the other surface of the process cartridge B (FIG. 17(*a*)) are guided along a guide member Gb (FIG. 19). As a result, when the process cartridge B is mounted into the image forming apparatus main assembly, a triangular coupling portion 70 (FIG. 17(*b*)) is engaged with a driving force transmitting portion 90 (FIG. 18), thus allowing driving force transmission to the process cartridge B.

According to this embodiment, the magnetic material sealing member has the above-described structure and mechanism, so that the following effects are achieved.

A complicated operation as in the conventional developing apparatus is not required in the mounting step but a simple operation such that the magnetic material sealing member 10*r* is only rotated relative to the developing means frame (the first and second developing means frames) while contacting the developing means frame is effected.

A frictional resistance caused by friction between the developing means frame and the magnetic material sealing member 10*r* is smaller than a resistance caused by compression and friction of the elastic lining as in the conventional developing apparatus. Further, the developing apparatus of the present invention requires less operation force, thus facilitating assembling properties.

By the elastic force caused by the elastic member 30, the outer contact surface 10*r*4 and the frame abutting surface 10*r*6 of the magnetic material sealing member 10*r* is press fitted in the developing means frame so that the magnetic material sealing member 10*r* is not separated from the developing means frame. Accordingly, the gap g1 between the developing roller 10*d* and the magnetic material sealing member 10*r* is kept constant thus improving the sealing performance of the magnetic material sealing member 10*r*.

In the conventional developing apparatus, the elastic lining member is adhered to the arcuate portion of the magnetic material sealing member but in this embodiment, the elastic member 30 is adhered to a planar elastic member abutting surface 10*r*5, so that an adhesive workability of the elastic member 30 is improved, thus facilitating a mounting performance.

Further, positioning of the magnetic material sealing member 10*r* is performed in a plane perpendicular to the lengthwise direction of the developing roller by the outer contact surface 10*r*4 and the frame abutting surface 10*r*6. Accordingly, it is not necessary to provide the magnetic material sealing member with a bent portion extending in the lengthwise direction of the developing roller as in the conventional developing apparatus. As a result, the developing device is made compact in the lengthwise direction and is also applicable to a developing means frame having a tight space in the lengthwise direction.

Embodiment 2

Figure 20:
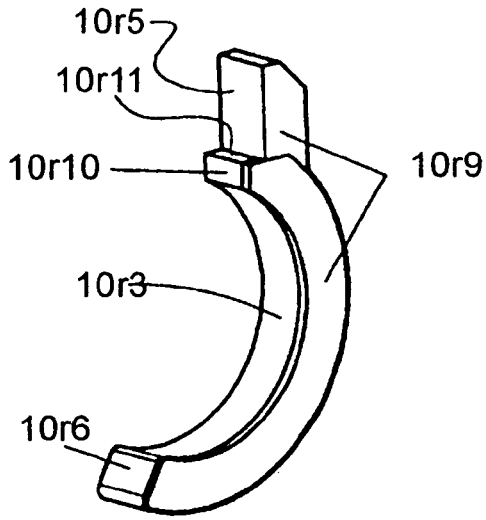
FIG. 20 is a perspective view of a magnetic material sealing member according to Embodiment 2 described later.
Figure 21:
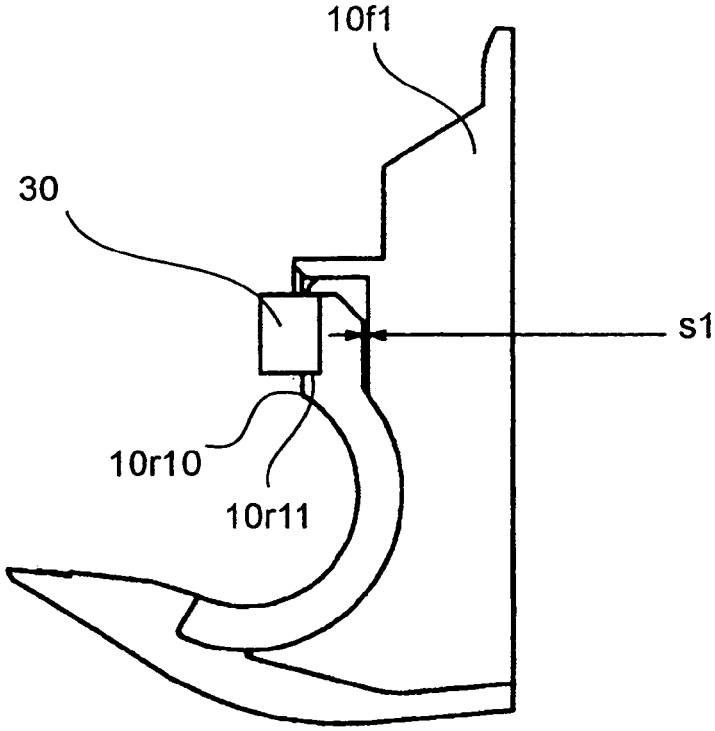
FIG. 21 is an explanatory sectional view showing a state that an elastic member is adhered to the magnetic material sealing member according to Embodiment 2.
Figure 22:
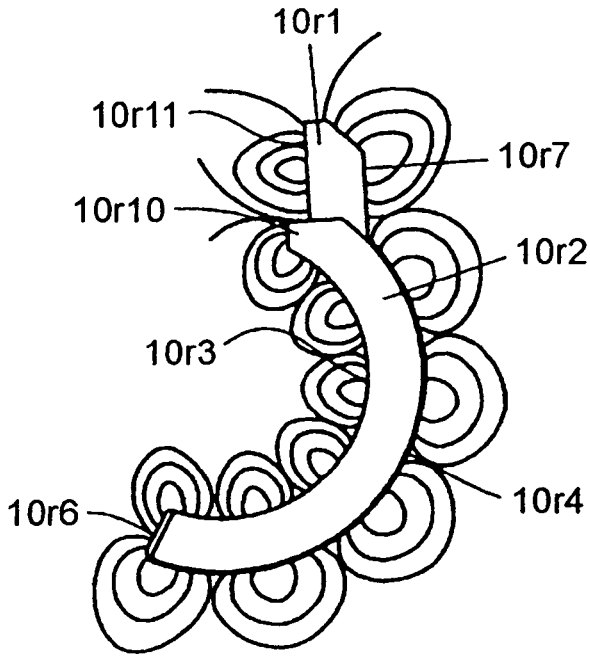
FIG. 22 is an explanatory view showing a state of occurrence of a magnetic field at the magnetic material sealing member of Embodiment 2.
Figure 23:
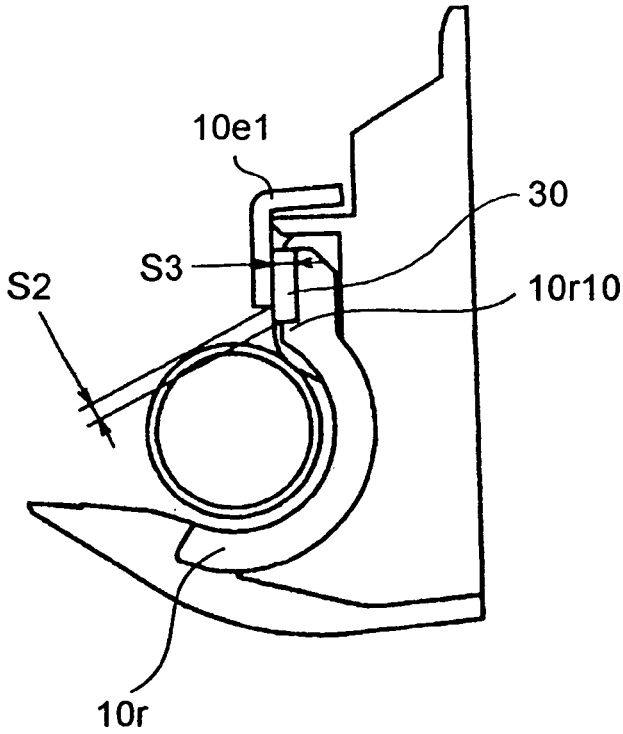
FIG. 23 is a schematic sectional view showing a positional relationship of the magnetic material sealing member of Embodiment 2, an elastic member, and a plate portion of a developing blade.
Figure 24:
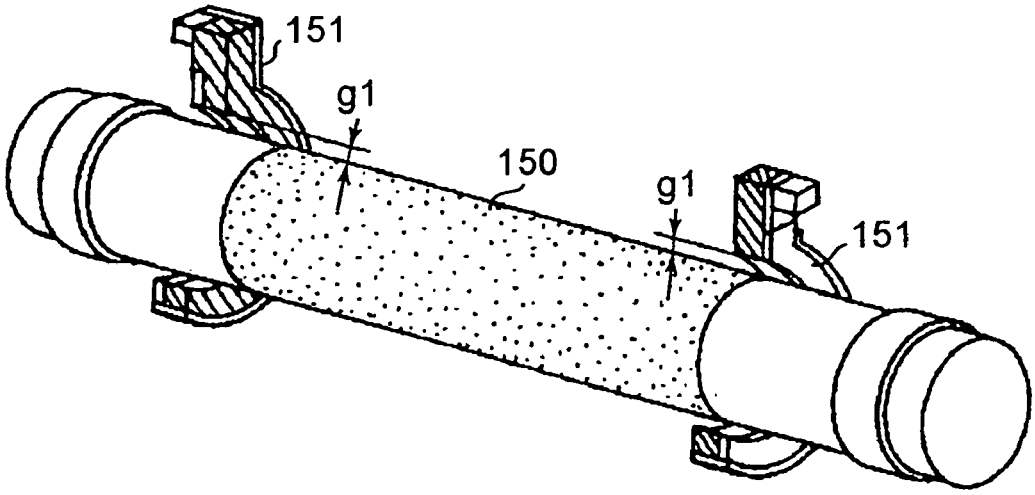
FIG. 24 is a perspective view of a conventional magnetic material sealing member describing the general structure thereof.
Figure 25:
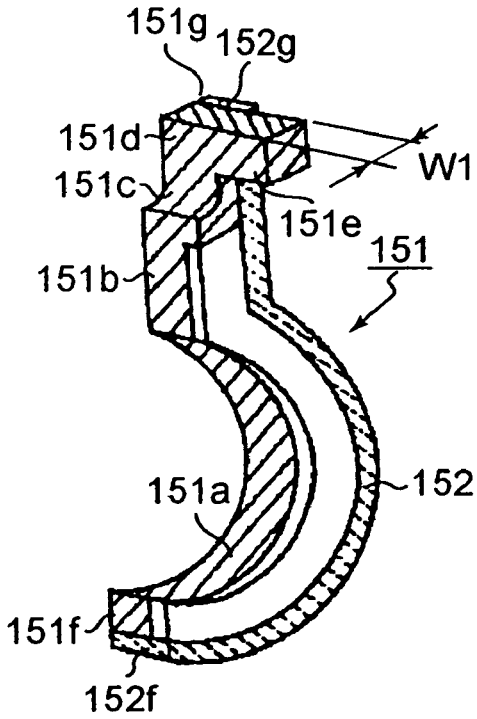
FIG. 25 is a perspective view of the conventional magnetic material sealing member describing the detailed structure thereof.
Figure 26:
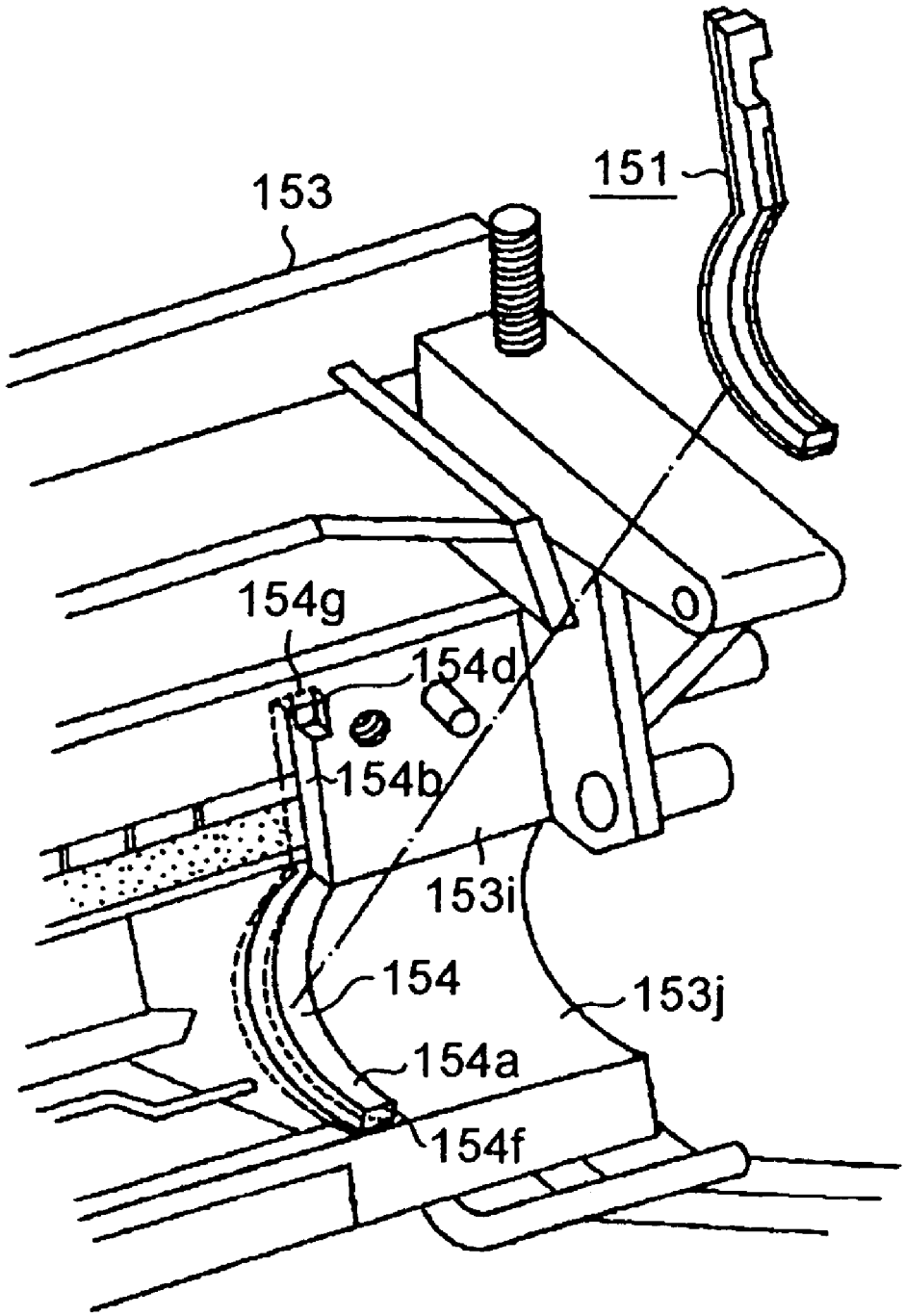
FIG. 26 is a detailed perspective view showing the conventional magnetic material sealing and a developing means frame.
Figure 27:
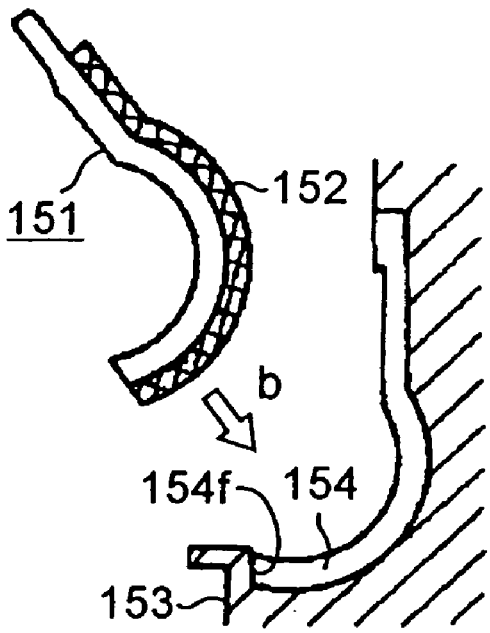
FIGS. 27(*a*) and (*b*) are schematic sectional views for illustrating a mounting method of the conventional magnetic material sealing member.
Figure 27:
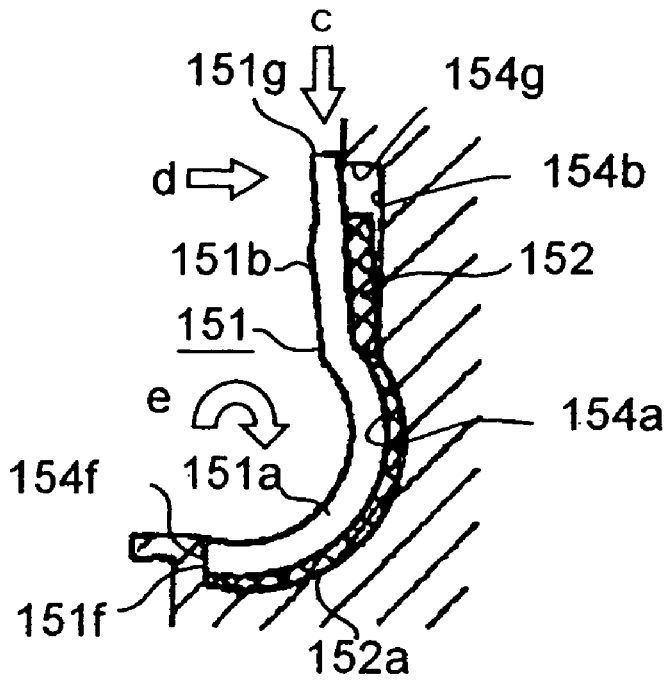
Figure 28:
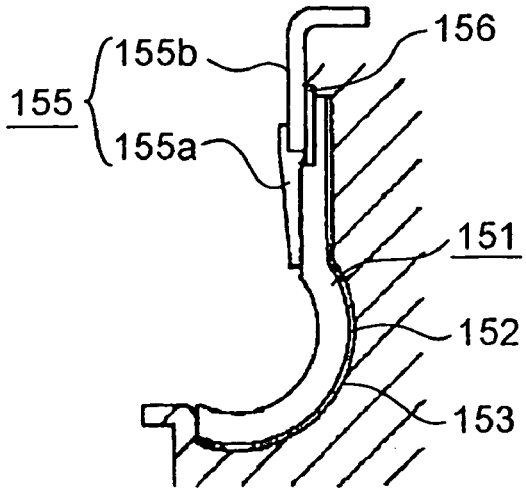
FIGS. 28(*a*) and (*b*) are schematic sectional views for illustrating a conventional method of preventing leak phenomenon.
Figure 28:
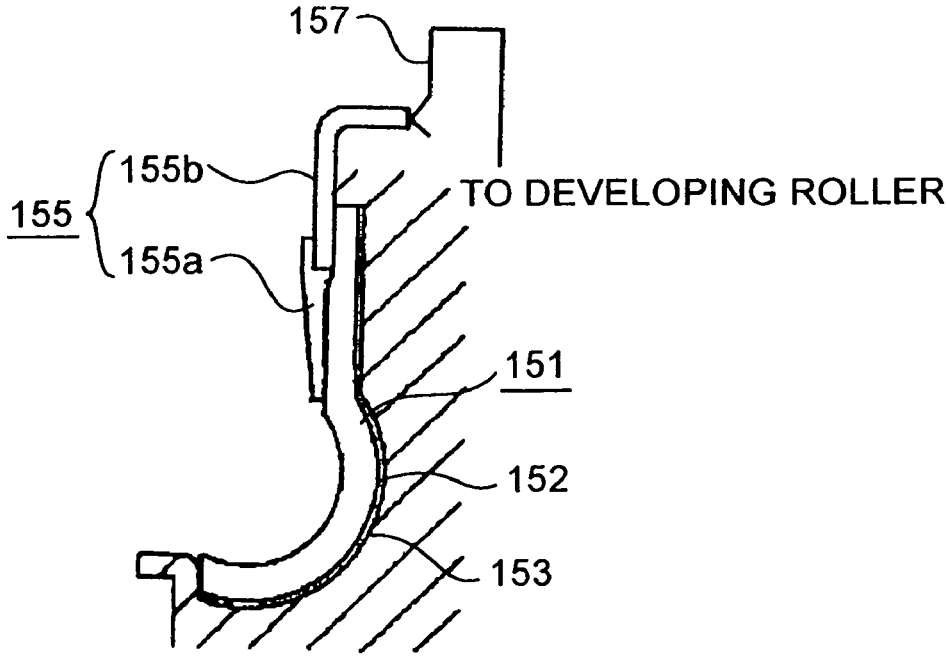

A second embodiment of the magnetic material sealing member according to the present invention will be described with reference to FIGS. 20-23. FIG. 20 is a perspective explanatory view of the magnetic material sealing member 10*r*; FIG. 21 is a sectional explanatory view showing a state such that an elastic member 30 is adhered to the magnetic material sealing member 10*r*; FIG. 22 is an explanatory view showing a state of generation of a magnetic field at the magnetic material sealing member 10*r*; and FIG. 23 is a sectional explanatory view showing a positional relationship among the magnetic material sealing member 10*r*, the elastic blade 30, and the metal plate portion 10*e*1 of the developing blade 10*e*. Identical reference numerals and signs are used for describing members (dimensions, directions, etc.) identical to those used in Embodiment 1 described above, and explanation thereof is omitted.

In this embodiment, as shown in FIGS. 20 and 21, a projection portion 10*r*10 which is protruded in a direction perpendicular to the elastic member abutting surface 10*r*5 is disposed between the inner peripheral surface 10*r*3 and the elastic member abutting surface 10*r*5 of the magnetic material sealing member 10*r*.

The projection portion 10*r*10 has a projection surface 10*r*11, which is substantially perpendicular to the elastic member abutting surface 10*r*5 and utilized as a striking surface at the time of adhesion of the elastic member 30 thereto, whereby a resultant positional accuracy for adhesion of the elastic member 30.

Further, as shown in FIG. 22, a inner peripheral surface opposite to the outer peripheral surface of the developing roller) of the magnet 10*r*1, the projection portion 10*r*10, the elastic member abutting surface 10*r*5, a backside surface 10*r*7 of the elastic member abutting surface 10*r*5, and the outer contact surface 10*r*4 are polarized to have a plurality of N- and S-poles. By polarizing the backside surface 10*r*7, a magnetic field is also created at minute gaps, caused by production-dimension error of the magnetic material sealing member 10*r* and the developing means frame (the first and second developing means frames 10*f*1 and 10*f*2), between the outer contact surface 10*r*4 and the mounting arcuate portion 10*f*14 of first developing means frame 10*f*1 and between the outer contact surface 10*r*4 and the mounting arcuate portion 10*f*24 of the second developing means frame 10*f*2. Further, also at the spacing S2 between the backside surface 10*f*7 and the first developing means frame 10*f*1, a magnetic field is created.

Accordingly, the toner leakage from the gaps (and spacing) between the magnetic material sealing member 10*r* and the developing means frame is prevented with reliability.

Further, an area of the inner peripheral surface is increased by providing the projection portion, a toner leakage preventing ability from the end portions of the developing roller 10*d* is further improved.

Next, countermeasures against leaks will be described with reference to FIG. 23.

The magnetic material sealing member 10*r* is charged by a voltage supplied to the developing roller 10*d* or triboelectric charge with the toner present between the developing roller 10*d* and the magnetic material sealing member 10*r*, so that electric charges are accumulated. In such an electrically unstable state that the magnetic material sealing member 10*r* and the metal plate portion 10*e*1 of the developing blade 10*e* are electrically connected or disconnected, leak is caused to occur between the magnetic material sealing member 10*r* and the metal plate portion 10*e*1 of the developing blade 10*e*, whereby noise is liable to occur.

In this embodiment, the magnetic material sealing member 10*r* and the metal plate portion 10*e*1 are completely placed in a non-contact state. More specifically, minimum distances between the metal plate portion 10*e*1 of the developing blade 10*e*1 and the projection portion 10*r*10 and between the metal plate portion 10*e*1 of the developing blade 10*e*1 and the elastic member abutting surface 10*r*5 are set to s2 and s2, respectively, determined in view of variations in distance on production, and these distances are set to be larger than a leak limit distance in view of a voltage supplied to the developing roller 10*d*. As a result, a direct leak from the magnetic material sealing member 10*r* to the metal plate portion 10*e*1 does not occur. Further, the elastic member 30 is electrically insulative (i.e., not electroconductive), thus causing no charge transfer therethrough.

As described above, according to this embodiment, it is possible to prevent noises caused by leak by making the elastic member 30 non-electroconductive without employing additional parts as countermeasure against leak. Accordingly, the developing apparatus of the present invention is advantageous in terms of production costs and assembly performance.

In the above-described Embodiments 1 and 2, the developer is used as an example of the magnetic particles. However, the magnetic material sealing member of the present invention is also applicable to a magnetic material sealing member as a means for preventing leakage of the electroconductive magnetic particles from both ends of the magnetic particle carrying member in the conventional developing apparatus of the magnetic brush charging scheme using the electroconductive magnetic particles as described above. In also such a case, effects similar to those achieved in Embodiments 1 and 2 are attained.

Further, in Embodiments 1 and 2, the magnetic material sealing member 10*r* is mounted into the developing means frames, i.e., the first and second developing means frames but may be mounted into one developing means frame as in the conventional developing apparatus. Also in this case, effects similar to those described above are achieved.

In Embodiment 2, the magnetic material sealing member 10*r* has the structure shown in FIGS. 21 and 22 described above, so that the following effects are attained.

A positional accuracy for adhesion of the elastic member is improved by using the projection surface of the projection portion 10*r*10 located substantially perpendicular to the elastic member abutting surface is utilized as the striking surface at the time of adhesion of the elastic member.

By imparting a magnetic force to the outer peripheral surface 10*r*4, the toner leakage from the gaps (and, spacing) between the magnetic material sealing member 10*r* and the developing means frame is prevented with reliability. Further, an area of the inner peripheral surface is increased by providing the projection portion 10*r*10, and a toner leakage preventing ability from the end portions of the developing roller 10*d* is further improved.

Further, it is possible to prevent noises caused by leakage by making the elastic member 30 non-electroconductive without employing additional parts as countermeasure against leakage. Accordingly, the developing apparatus of the present invention is advantageous in terms of production costs and assembly performance.

Other Embodiments

The process cartridge used in the above described embodiments is used for forming a monochrome image but the process cartridge used in the developing apparatus of the present invention may also be suitably applicable to a process cartridge for forming a plurality of color images (e.g., two color images, three color images, full-color images) in combination with a plurality of developing means.

As for the electrophotographic photoconductive substance compatible with the above-described embodiments, such a photoconductive substance as amorphous silicon, amorphous selenium, zinc oxide, titanium oxide, and various organic photoconductors (OPC), can be included. Incidentally, the photosensitive member in the above-described embodiments may comprise a drum (cylinder) or belt formed of aluminum alloy or the like, and a layer of photoconductive substance placed on the peripheral surface of the cylinder or belt by deposition, painting, or the like.

The above-described embodiments of the present invention are compatible with various well-known developing methods, for example, the two-component magnetic brush developing method, cascade developing method, touch-down developing method, cloud developing method, etc.

In the above-described embodiments, a so-called contact charging method is employed as a charging method but may be changed to other conventional methods such as a charging method wherein a metal shield is provided to three peripheral portions of a tungsten wire and positive or negative ions generated by applying a high voltage to the tungsten wire are moved to the surface of the photosensitive drum to uniformly electrically charge the photosensitive drum surface.

In addition to the roller-type charging means described above, it is also possible to use various charging means of a blade-type (charging blade), a pad-type, a block-type, a rod-type, and a wire-type.

As a means for removing the toner remaining on the photosensitive drum, cleaning means of blade-type a fur-brush type, and a magnetic-brush type may be applicable.

The process cartridge used in the present invention comprises, e.g., the electrophotographic photosensitive member and at least one of a plurality of process means.

The present invention is compatible with: a cartridge in which an electrophotographic photoconductive member, and a developing means are integrally disposed, and which is removably mountable in the main assembly of an image forming apparatus; a cartridge in which an electrophotographic photoconductive member, a developing means, and a charging means or a cleaning means are integrally disposed, and which is removably mountable in the main assembly of an image forming apparatus; and the like, in addition to the process cartridge B in the above-described embodiments of the present invention. In other words, the process cartridge used in the present invention includes at least a developing means and an electrophotographic photosensitive member which are integrally disposed to form a cartridge which is detachably mountable to the main assembly of an image forming apparatus. This process cartridge can be mounted into and demounted from the apparatus main body by a user. Accordingly, maintenance of the apparatus main body can be effected by a user alone.

Further, the electrophotographic image forming apparatus is the laser beam printer in the above embodiment but is also applicable to other electrophotographic image forming apparatuses such as an electrophotographic copying machine, an electrophotographic printer such as an LED printer, a facsimile apparatus, a word processor, a combination of two or ore of the preceding apparatuses such as a multiple function printer.

According to the present invention, the magnetic material sealing member is constituted as described hereinabove. As a result, the magnetic material sealing member can be simply assembled in a small space only by rotating it in contact with the developing means frame and can effect sealing with reliability.

Furthermore, the present invention is not limited to the above-described embodiments, and variations and modifications may be made within the scope of the present invention.

What is claimed is:

1. A developing apparatus, comprising:

a developer container for containing a developer;

a developer carrying member to be rotated while carrying the developer thereon, said developer carrying member being provided in an opening portion of said developer container; and a sealing member which extends in a circumferential direction of said developer carrying member in a vicinity of an end of said developer carrying member and regulates movement of the developer toward the end of said developer carrying member by a magnetic force, said sealing member including an arcuate portion extended along a peripheral surface of said developer carrying member and a non-arcuate portion disposed at an end, in a circumferential direction, of the arcuate portion, wherein an end surface of the arcuate portion of said sealing member on a side where said non-arcuate portion is not provided, is inclined such that a center of arcuation of said arcuate portion is located in an area opposite to an area in which said arcuation portion is located when the two areas are partitioned by a phantom plane including said end surface, and wherein said end surface is abutted against a mounting end surface provided on said developer container so that said arcuate portion is pressed against a mounting arcuate portion provided on said developer container.

2. An apparatus according to claim 1, wherein said apparatus further comprising urging means for pressing said non-arcuate portion.

3. An apparatus according to claim 2, wherein said urging means includes a layer thickness regulation member for regulating a thickness of a layer of the developer to be carried by said developer carrying member and an elastic member to be disposed between said non-arcuate portion and said layer thickness regulation member.

4. An apparatus according to claim 3, wherein said elastic member is electrically insulative.

5. An apparatus according to claim 3, wherein a projection is disposed between said arcuate portion and said non-arcuate portion.

6. An apparatus according to claim 1, wherein said sealing member includes a magnet and a magnetic material.

* * * * *

UNITED STATES PATENT AND TRADEMARK OFFICE

CERTIFICATE OF CORRECTION

PATENT NO. : 7,336,914 B2
APPLICATION NO. : 11/362229
DATED : February 26, 2008
INVENTOR(S) : Yoshiyuki Batori et al.

It is certified that error appears in the above-identified patent and that said Letters Patent is hereby corrected as shown below:

COLUMN 3:
Line 60, “elastic,” should read --elastic--.
Line 66, “leak” should read --leakage--.

COLUMN 6:
Line 32, “invention,” should read --invention--.
Line 41, “to” should be deleted.
Line 48, “which” should be deleted.
Line 52, “which” should be deleted.
Line 67, “the-detailed” should read --the detailed--.

COLUMN 10:
Line 56, “described” should read --described in--.

COLUMN 11:
Line 24, “0.1-10.7 mm,” should read --0.1-0.7 mm,--.

COLUMN 12:
Line 7, “seconds” should read --second--.

COLUMN 13:
Line 51, “since,” should read --since--.

COLUMN 15:
Line 54, “constant” should read --constant,--.

COLUMN 16:
Line 39, “a” should read --an--.

COLUMN 18:
Line 6, “above described” should read --above-described--.
Line 43, “blade-type” should read --blade-type,--
Line 57, “apparatus;” should read --apparatus,--.

UNITED STATES PATENT AND TRADEMARK OFFICE

CERTIFICATE OF CORRECTION

PATENT NO. : 7,336,914 B2
APPLICATION NO. : 11/362229
DATED : February 26, 2008
INVENTOR(S) : Yoshiyuki Batori et al.

It is certified that error appears in the above-identified patent and that said Letters Patent is hereby corrected as shown below:

COLUMN 19:

Line 7, "ore" should read --more--.

Signed and Sealed this

Nineteenth Day of August, 2008

JON W. DUDAS
*Director of the United States Patent and Trademark Office*